US010863809B2

(12) United States Patent
Godshaw et al.

(10) Patent No.: US 10,863,809 B2
(45) Date of Patent: Dec. 15, 2020

(54) ANTI-THEFT LOCKDOWN CARRYING BAGS AND CARRYING STRAPS

(71) Applicant: Travel Caddy, Inc., Elk Grove Village, IL (US)

(72) Inventors: Donald E. Godshaw, Wilmette, IL (US); Jason Michael Kramer, Greendale, IN (US); Bryce Ryan Hickman, Schaumburg, IL (US)

(73) Assignee: Travel Caddy, Inc., Franklin Park, IL (US)

( * ) Notice: Subject to any disclaimer, the term of this patent is extended or adjusted under 35 U.S.C. 154(b) by 340 days.

(21) Appl. No.: 15/879,194

(22) Filed: Jan. 24, 2018

(65) Prior Publication Data

US 2018/0255893 A1 Sep. 13, 2018

Related U.S. Application Data

(60) Provisional application No. 62/450,405, filed on Jan. 25, 2017.

(51) Int. Cl.

| | |
|---|---|
| ***A45C 13/18*** | (2006.01) |
| *A45C 13/36* | (2006.01) |
| *A45C 13/10* | (2006.01) |
| *A45C 13/02* | (2006.01) |
| *A45C 7/00* | (2006.01) |

(52) U.S. Cl.

CPC ..... *A45C 13/18* (2013.01); *A45C 7/0086* (2013.01); *A45C 13/02* (2013.01); *A45C 13/10* (2013.01); *A45C 13/36* (2013.01)

(58) Field of Classification Search

CPC ..... A45C 12/18; A45C 13/30; A45C 13/36; A45C 13/185; A45C 13/18

USPC ..... 150/102, 112

See application file for complete search history.

(56) References Cited

U.S. PATENT DOCUMENTS

| | | | | |
|---|---|---|---|---|
| 2,270,775 | A * | 1/1942 | Stember | A45C 3/06 150/101 |
| 3,587,698 | A * | 6/1971 | Ritter | A45C 7/0077 150/116 |
| 5,152,612 | A * | 10/1992 | Shoemaker | A41D 3/00 383/4 |
| 5,490,619 | A * | 2/1996 | Boyar | A45C 7/0077 150/103 |
| 2008/0128058 | A1* | 6/2008 | Bodine | A45C 13/20 150/102 |

(Continued)

*Primary Examiner* — Sue A Weaver

(74) *Attorney, Agent, or Firm* — Nancy R. Gamburd; Gamburd Law Group LLC

(57) ABSTRACT

In various embodiments, a carrying bag includes a carrying bag body formed by a security panel assembly comprising a cut-resistant fabric or mesh, with a strap channel having at least two spaced-apart reinforced channel openings; and a carrying strap comprising: first and second wire cables; a first flexible material having a first lateral region folded around the first wire cable to enclose the first wire cable and a second lateral region folded around the second wire cable to enclose the second wire cable; and a second flexible material arranged on or over a central region of the first flexible material. Representative embodiments may include a water-resistant pocket coupled to a protected seam and extending to an exterior of the carrying bag body; and a fastener to close the water-resistant pocket external to the carrying bag body.

32 Claims, 32 Drawing Sheets

(56) References Cited

U.S. PATENT DOCUMENTS

2018/0146759 A1* 5/2018 Godshaw ..... A45C 5/02

* cited by examiner

ANTI-THEFT LOCKDOWN CARRYING BAGS AND CARRYING STRAPS

CROSS-REFERENCE TO A RELATED APPLICATION

This application is a nonprovisional of and claims priority to and the benefit of U.S. Provisional Patent Application No. 62/450,405, filed Jan. 25, 2017, inventors Donald E. Godshaw et al., titled "Anti-Theft Carrying Bags and Security Panel Assemblies", which is commonly assigned herewith, the entire contents of which are incorporated herein by reference with the same full force and effect as if set forth in its entirety herein, and with priority claimed for all commonly disclosed subject matter.

FIELD OF THE INVENTION

This invention relates to various types of carrying bags and, more particularly, to a cut or slash-resistant carrying bag with a self-locking cut or slash-resistant carrying strap for carrying bags such as purses, backpacks, messenger bags, briefcases, luggage, and so on.

BACKGROUND OF THE INVENTION

Handbags, travel bags, purses, backpacks, messenger bags, briefcases, waist packs, draw-string sacks, suitcases, luggage and other types of carrying bags (individually and collectively referred to as "bag(s)" or "carrying bag(s)") are often made from flexible materials such as cloth, canvas, nylon, ballistic nylon, leather and similar materials. Such bags typically include one or more interior chambers through which access may be gained by an opening in the top or side of the bag. Such bags also often include a carry (or carrying) strap which is typically connected between opposite sides of the bag. Additionally, such bags often also include multiple side pockets with top and/or side access openings.

On occasion, such bags are subject to theft or attempted theft. For example, often a bag may be hung or supported by the bag carrying (or carry) strap on a chair or a hook or the like. In such circumstances, a thief may "snatch" the bag by grabbing the carrying strap and departing. Another scheme that has been used by thieves is to use a sharp instrument, such as a knife or box cutter, to cut through the soft-sided material comprising the bag, and thereby gain access to the contents which may be lifted through the cut opening in the bag, or which may fall out from the cut opening of the bag when a lower part of the bag has been slashed. Yet another scheme that has been used by thieves includes various types of pickpocketing, such as by unzipping a zipper in either a stealth manner or while the bag's owner is distracted, and thereby gaining access to the bag's contents while undetected by the bag's owner.

Of particular concern are situations in which a bag may be left unattended, for any period of time, including brief periods of time. For example, people at a beach may carry their belongings in a purse, a beach bag, a backpack, and so on, and desire to leave the carrying bag on the beach while they swim, wade, splash or surf in the water. In such circumstances, a person's attention is often on their activities, and the carrying bag is not being observed at all or most times, and such an unattended carrying bag is a prime target for potential theft. While unattended, moreover, a potential thief typically has considerably more time in which to attempt to gain access to the contents of the bag, especially compared with the much more rapidly occurring grabbing, pickpocketing or slashing of a carrying bag.

In addition, for many activities such as swimming and boating, such a carrying bag may also not only get wet from various activities, but also may be utilized to store wet or damp contents.

Accordingly, a need remains for comparatively cut or slash-resistant carrying bags, which are relatively easy and comparatively inexpensive to assemble, which have comparatively thin, non-bulky configurations, and which are light and flexible. A need also remains for additional anti-theft features for carrying straps and openings of bags, to prevent cutting through any strap attached to the bag, to prevent typical "snatching" of bags, and further to provide readily and easily usable locking capabilities for straps, including while unattended, to eliminate or diminish the potential for undetected access to the contents of the bag, while nonetheless maintaining a comparatively flexible and attractive style of the bag for the consumer.

SUMMARY

The representative embodiments provide comparatively cut or slash-resistant carrying bags, which are relatively easy and comparatively inexpensive to assemble, which have comparatively thin, non-bulky configurations, and which are light and flexible. Representative embodiments include additional anti-theft features for carrying straps and openings of bags, to prevent cutting through any strap attached to the bag, to prevent typical "snatching" of bags, and further to provide readily and easily usable locking capabilities for straps, including while unattended, to eliminate or diminish the potential for undetected access to the contents of the bag, while nonetheless maintaining a comparatively flexible and attractive style of the bag for the consumer.

In another representative embodiment, a carrying bag comprises: a carrying bag body comprising: a first security panel assembly comprising a first plurality of cut-resistant polymer-based fibers, threads or yarns forming a fabric or mesh; and a strap channel arranged in an upper part of the first security panel assembly forming the carrying bag body, the strap channel having at least two spaced-apart reinforced channel openings; with the carrying bag further comprising a carrying strap arranged in the strap channel and extending through the two spaced-apart reinforced channel openings, the carrying strap comprising: a first wire cable; a second wire cable extending substantially parallel to and spaced-apart from the first wire cable; a first flexible material having first and second lateral regions and a central region in between the first and second lateral regions, the first lateral region folded around the first wire cable to enclose the first wire cable and the second lateral region folded around the second wire cable to enclose the second wire cable; and a second flexible material arranged on or over the central region of the first flexible material. Such an embodiment may also include a water-resistant pocket having a first part coupled within an interior of the carrying bag body and having a second part extending to an exterior of the carrying bag body; and a fastener coupled to the water-resistant pocket to fasten the water-resistant pocket in a first closed position external to the carrying bag body.

In a representative embodiment, each of the first and second flexible materials of the carrying strap further comprise spaced-apart first and second apertures, each of the first and second apertures extending through both the first and second flexible materials, and wherein the carrying strap further comprises: first and second through-hole reinforcements correspondingly coupled to the first and second apertures and to the first and second flexible materials. In a representative embodiment the carrying strap further comprises: a second security panel assembly comprising a second plurality of cut-resistant polymer-based fibers, threads or yarns, the second security panel assembly arranged around the first aperture and in between the first and second flexible materials; and a third security panel assembly comprising a third plurality of cut-resistant polymer-based fibers, threads or yarns, the third security panel assembly arranged around the second aperture and in between the first and second flexible materials.

In a representative embodiment, the carrying strap further comprises: a second security panel assembly comprising a second plurality of cut-resistant polymer-based fibers, threads or yarns, the second security panel assembly arranged in between the first and second flexible materials and around the first and second apertures. In a representative embodiment, the first through-hole reinforcement comprises a first grommet and the second through-hole reinforcement comprises a second grommet.

In a representative embodiment, the first lateral region of the first flexible material of the carrying strap is further folded to overlay and be coupled through a first strap seam to a first lateral region of the second flexible material, and wherein the second lateral region of the first flexible material is further folded to overlay and be coupled through a second strap seam to a second lateral region of the second flexible material. In a representative embodiment, the first and second through-hole reinforcements are further coupled over the first and second strap seams coupling the first and second flexible materials. In a representative embodiment, the carrying strap further comprises a locking ring.

In a representative embodiment, the carrying bag may further comprise: one or more crimps coupling a first end of the first wire cable to a second end of the first wire cable and coupling a first end of the second wire cable to a second end of the second wire cable to form a loop structure for the carrying strap. In a representative embodiment, the carrying bag may further comprise: a capping reinforcement coupled over the one or more crimps and coupled to the first and second flexible materials, the capping reinforcement further coupled to the strap channel. In a representative embodiment, the strap channel may further comprise: a first protected seam having a plurality of rows of stitching, each row of stitching extending around a circumference of the carrying bag body. For example, the first protected seam may further comprise a plurality of hidden stitches which do not extend to an exterior of the carrying bag body.

In a representative embodiment, the carrying bag body may further comprise: a second protected seam arranged on a lower part of the carrying bag body, the second protected seam having a double-lapped structure, the double-lapped structure comprising a first lapped structure and a second lapped structure, the first lapped structure having a plurality of hidden stitches which do not extend to an exterior of the carrying bag body. In a representative embodiment, the carrying bag body may further comprise: a second protected seam arranged on a lower part of the carrying bag body, the second protected seam selected from the group consisting of: a single-lapped seam, a double-lapped seam, a French seam, a flat felled seam, and a bound seam.

In a representative embodiment, the carrying bag body has an upper rim and has an interior, the carrying bag body further having a protected seam, and the carrying bag may further comprise: a water-resistant pocket having a first part coupled within the interior to the protected seam, and the water-resistant pocket having a second part extending past the upper rim to an exterior of the carrying bag body; and a fastener coupled to the water-resistant pocket to fasten the water-resistant pocket in a first closed position external to the carrying bag body. In a representative embodiment, the second part of the water-resistant pocket is foldable to be placed within the interior in a second closed position.

In another representative embodiment, the carrying bag body has an upper rim and has an interior, the carrying bag body further having a protected seam, and the carrying bag further comprising: a water-resistant pocket having a plurality of side tabs coupled within the interior to one or more sides of the carrying bag body, the water-resistant pocket extending past the upper rim to an exterior of the carrying bag body; and a fastener coupled to the water-resistant pocket to fasten the water-resistant pocket in a first closed position external to the carrying bag body.

In a representative embodiment, the reinforced channel openings further comprise welded and knit channel openings. In a representative embodiment, the carrying bag may further comprise: an exterior cover coupled to the carrying bag body.

In another representative embodiment, a carrying bag comprises: a carrying bag body comprising: a first security panel assembly comprising a plurality of cut-resistant polymer-based fibers, threads or yarns; and a strap channel arranged in an upper part of the body, the strap channel having at least two spaced-apart reinforced channel openings; with the carrying bag further comprising: a carrying strap arranged in the strap channel and extending through the two spaced-apart reinforced channel openings, the carrying strap comprising: a first wire cable; a second wire cable extending substantially parallel to and spaced-apart from the first wire cable; a first flexible material and a second flexible material, each of the first and second flexible materials having first and second lateral regions and a central region in between the first and second lateral regions, the second flexible material arranged on or over the central region of the first flexible material, the first lateral region of the first flexible material folded around the first wire cable to enclose the first wire cable and to overlay the first lateral region of the second flexible material, and the second lateral region of the first flexible material folded around the second wire cable to enclose the second wire cable and to overlay the second lateral region of the second flexible material, and each of the first and second flexible materials having spaced-apart first and second apertures, each of the first and second apertures extending through both the first and second flexible materials; and first and second through-hole reinforcements correspondingly coupled to the first and second apertures and to the first and second flexible materials. Such an embodiment may also include a water-resistant pocket having a first part coupled within an interior of the carrying bag body and having a second part extending to an exterior of the carrying bag body; and a fastener coupled to the water-resistant pocket to fasten the water-resistant pocket in a first closed position external to the carrying bag body.

In another representative embodiment carrying bag comprises: a carrying bag body having an upper rim and an interior, the carrying bag body comprising: a first security panel assembly comprising a plurality of cut-resistant polymer-based fibers, threads or yarns; a strap channel arranged in an upper part of the body, the strap channel having at least two spaced-apart reinforced channel openings; a protected seam arranged on a lower part of the carrying bag body, the protected seam having a double-lapped structure, the double-lapped structure comprising a first lapped structure and a second lapped structure, the first lapped structure having a plurality of hidden stitches which do not extend to an exterior of the carrying bag body; with the carrying bag further comprising a water-resistant pocket having a first part coupled within the interior to the protected seam, and the water-resistant pocket having a second part extending past, the upper rim to an exterior of the carrying bag body; a fastener coupled to the water-resistant pocket to fasten the water-resistant pocket in a first closed positron external to the carrying bag body; and a carrying strap arranged in the strap channel and extending through the two spaced-apart reinforced channel openings, the carrying strap comprising: a first wire cable; a second wire cable extending substantially parallel to and spaced-apart from the first wire cable; a first flexible material and a second flexible material, each of the first and second flexible materials having first and second lateral regions and a central region in between the first and second lateral regions, the second flexible material arranged on or over the central region of the first flexible material, the first lateral region of the first flexible material folded around the first wire cable to enclose the first wire cable and coupled through a first strap seam to the first lateral region of the second flexible material, and the second lateral region of the first flexible material folded around the second wire cable to enclose the second wire cable and coupled through a second strap seam to the second lateral region of the second flexible material, and each of the first and second flexible materials having spaced-apart first and second apertures, each of the first and second apertures extending through both the first and second flexible materials; and first and second through-hole reinforcements correspondingly coupled to the first and second apertures and further coupled over the first and second strap seams coupling the first and second flexible materials to the first and second flexible materials.

Numerous other advantages and features of the present invention will become readily apparent from the following detailed description of the invention and the embodiments thereof, from the claims and from the accompanying drawings.

BRIEF DESCRIPTIONS OF THE DRAWINGS

The objects, features and advantages of the present invention will be more readily appreciated upon reference to the following disclosure when considered in conjunction with the accompanying drawings, wherein like reference numerals are used to identify identical components in the various views, and wherein reference numerals with alphabetic characters and/or numeric subscripts are utilized to identify parts or subparts of a component or additional types, instantiations or variations of a selected component embodiment in the various views, as further indicated by textual context, in which.

Figure 8:
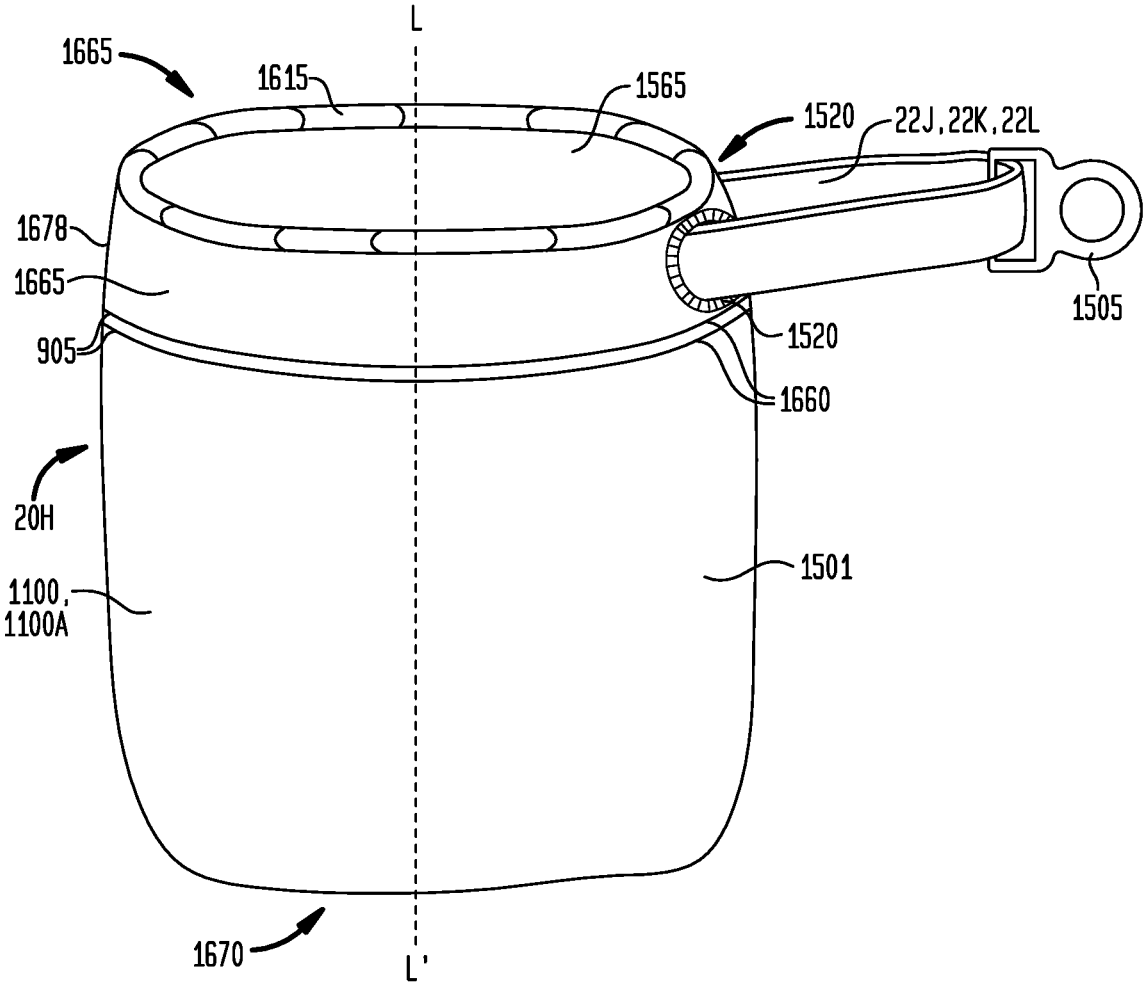
FIG. 8 is an isometric front view of an exemplary or representative embodiment of a carrying bag in an open configuration having an additional embodiment of a security panel assembly forming the exterior of the bag.
Figure 15:
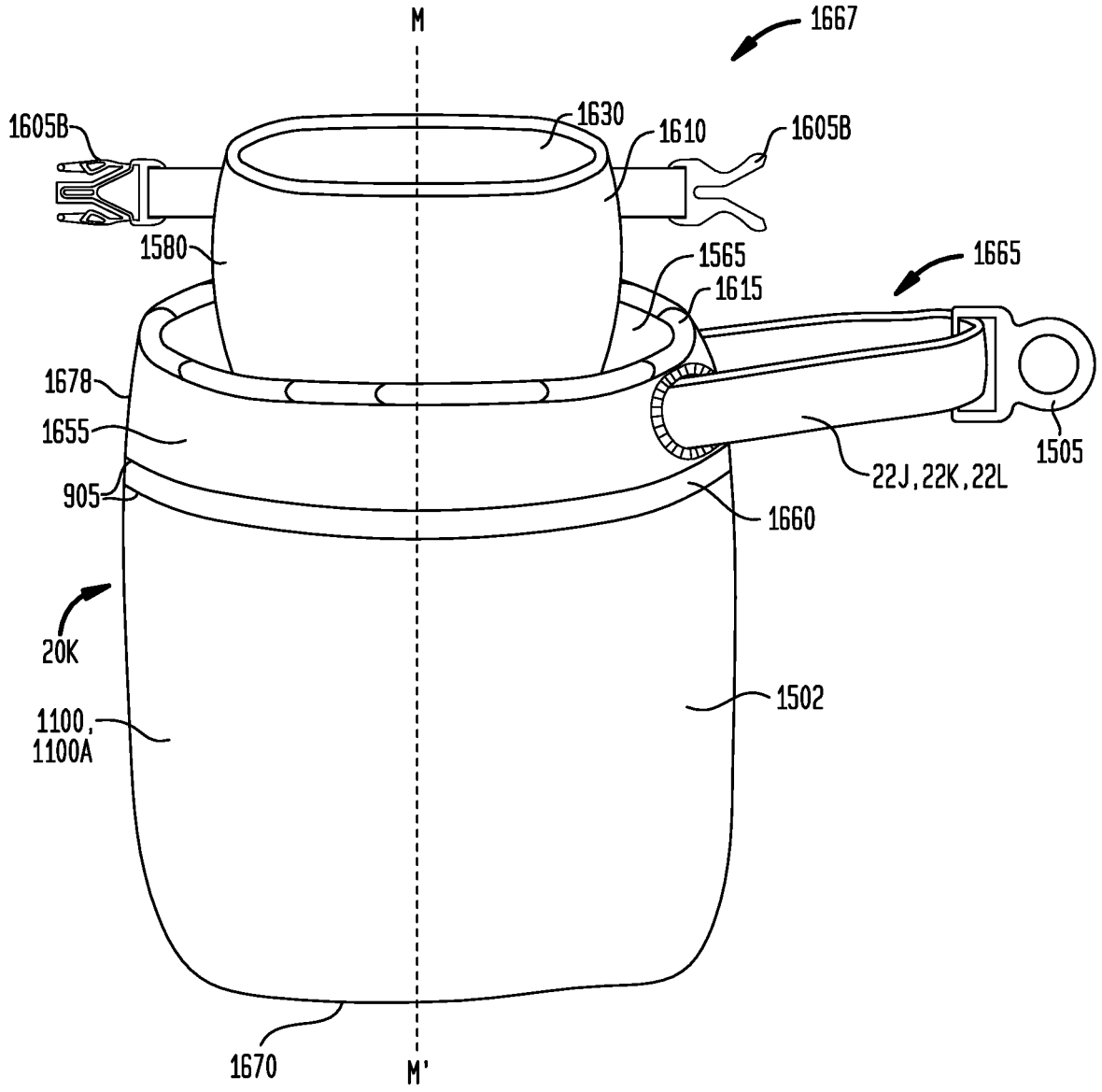
FIGS. 15 and 16 are isometric front views of an exemplary or representative embodiment of a carrying bag in an open configuration, having an additional embodiment of a security panel assembly forming the body and exterior of the bag and having an exemplary or representative second interior pocket in an open configuration.
Figure 34:
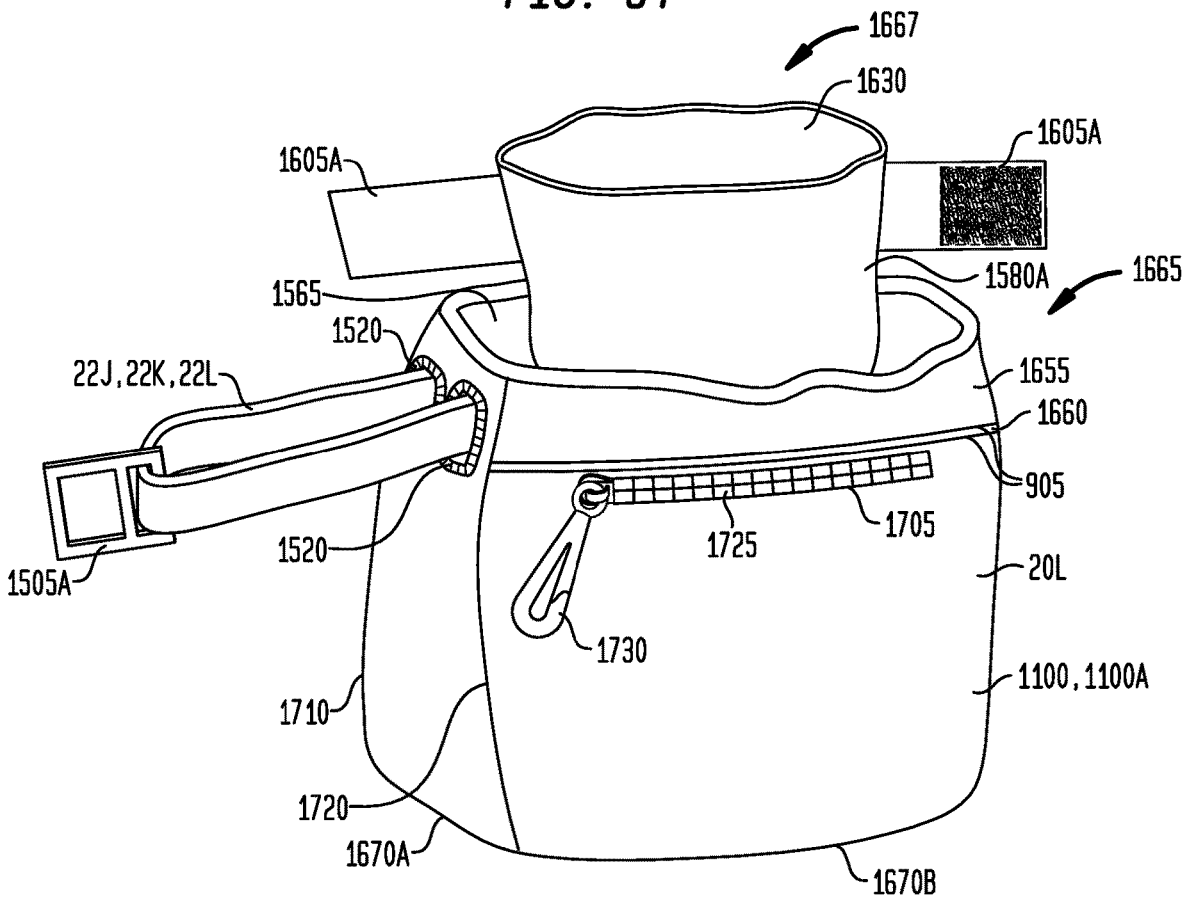

FIGS. 23A, 23B, 23C and 23D (collectively referred to as FIG. 23) are cross-sectional views of exemplary or representative embodiments of protected second or side seams and/or steps in their formation for the exemplary or representative carrying bags of FIGS. 8, 15 and 34.

Figure 24A:
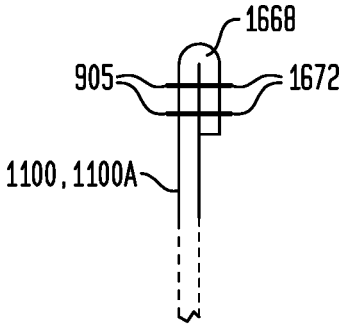
Figure 24B:
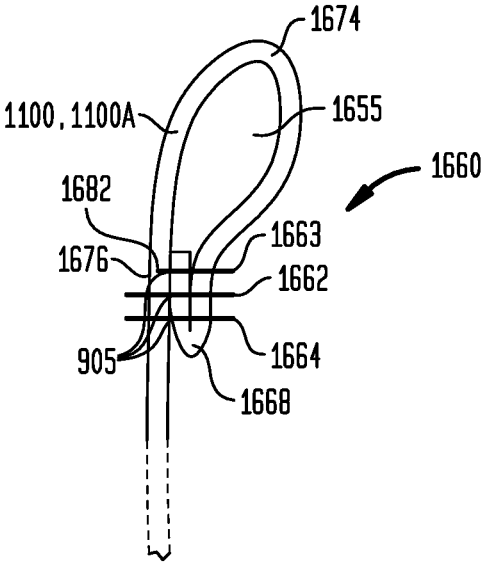

FIGS. 24A and 24B (collectively referred to as FIG. 24) are cross-sectional views of exemplary or representative embodiments of a protected first seam and/or steps in its formation for the exemplary or representative carrying bags of FIGS. 8, 15 and 34.

Figure 25:
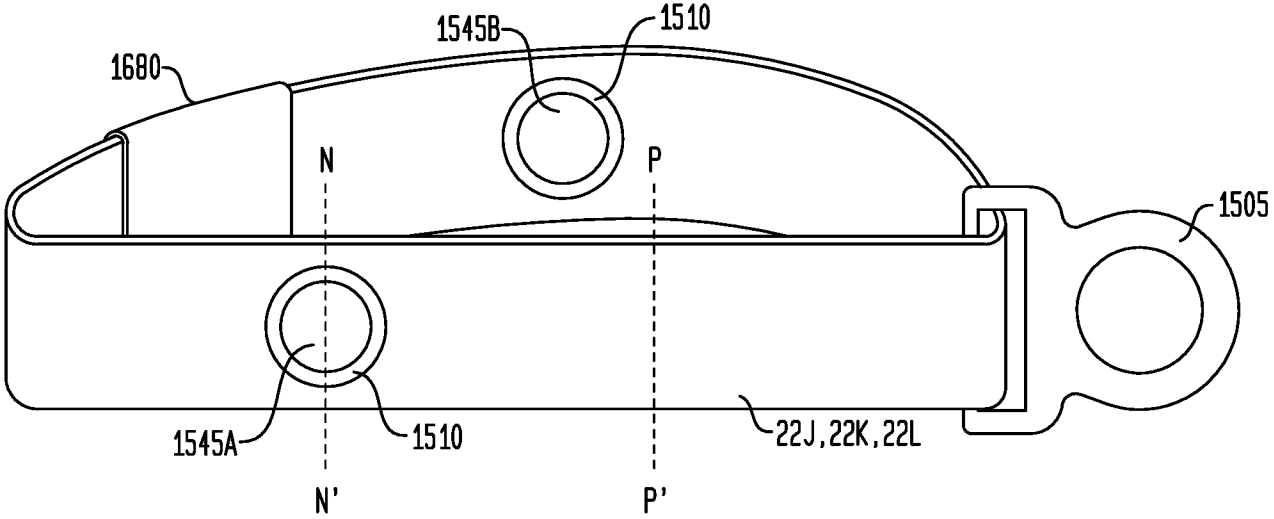

FIG. 25 is an isometric view of exemplary or representative first, second and third embodiments of a self-locking carrying strap.

Figure 26:
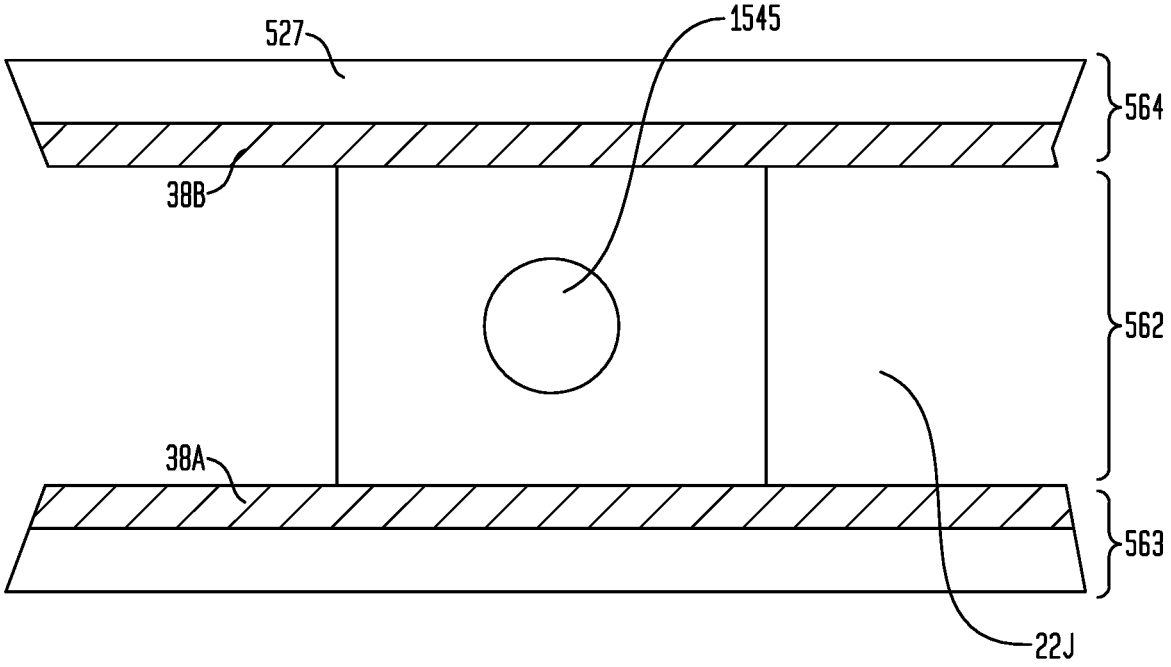

FIG. 26 is a cut-away plan view of an exemplary or representative first embodiment of a self-locking carrying strap.

Figure 27:
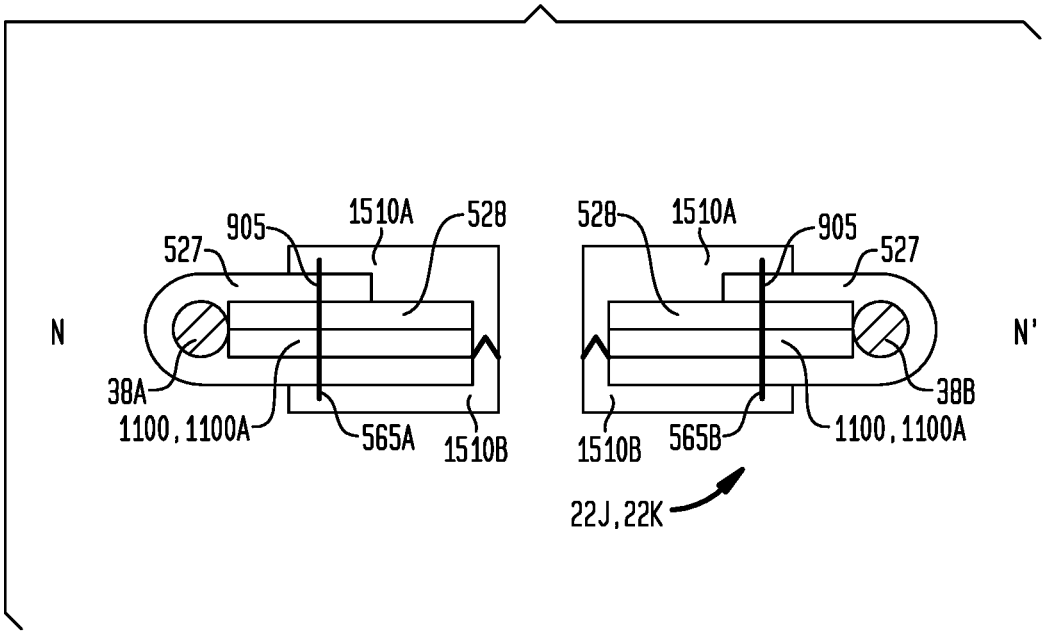

FIG. 27 is a first cross-sectional view (through the N-N' plane) of the exemplary or representative first and second embodiments of a self-locking carrying strap.

Figure 28:
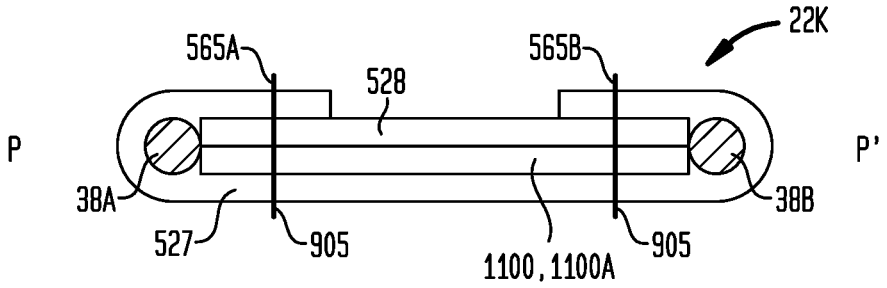

FIG. 28 is a second cross-sectional view (through the P-P' plane) of the exemplary or representative second embodiment of a self-locking carrying strap.

Figure 29:
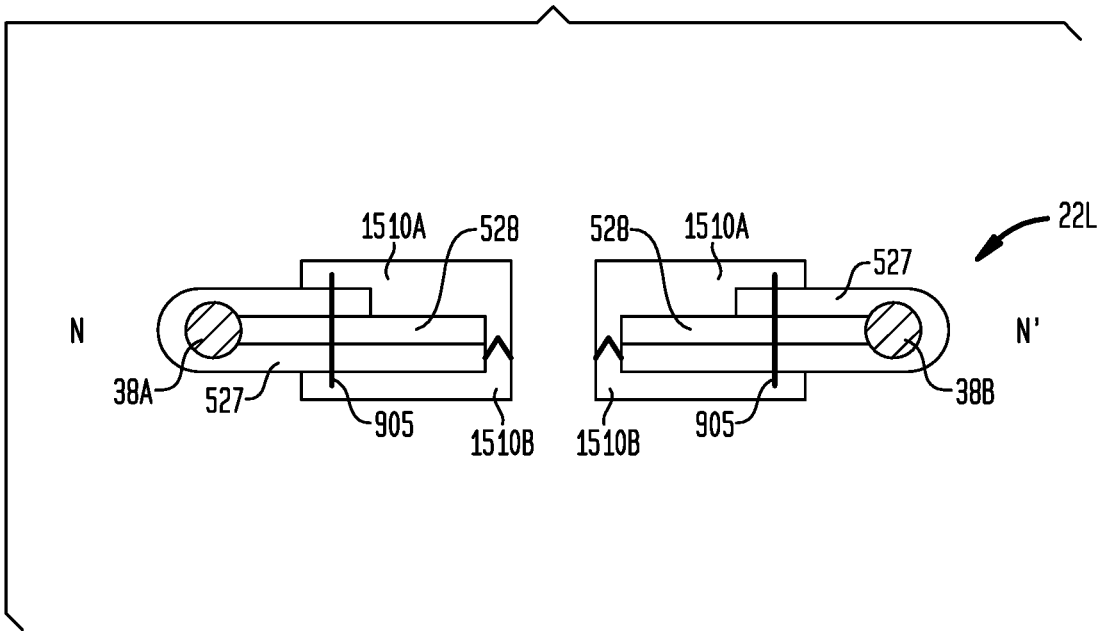

FIG. 29 is a third cross-sectional view (through the N-N' plane) of the exemplary or representative third embodiment of a self-locking carrying strap.

Figure 30:
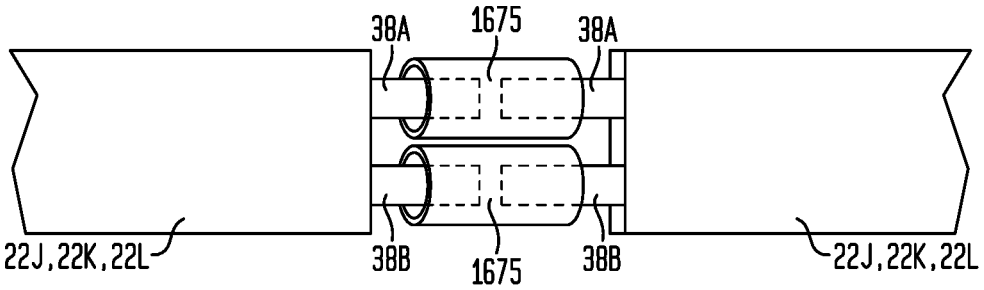

FIG. 30 is an isometric view of an exemplary or representative crimping or other coupling of embedded wire cables of the first, second and third embodiments of a self-locking carrying strap.

Figure 31:
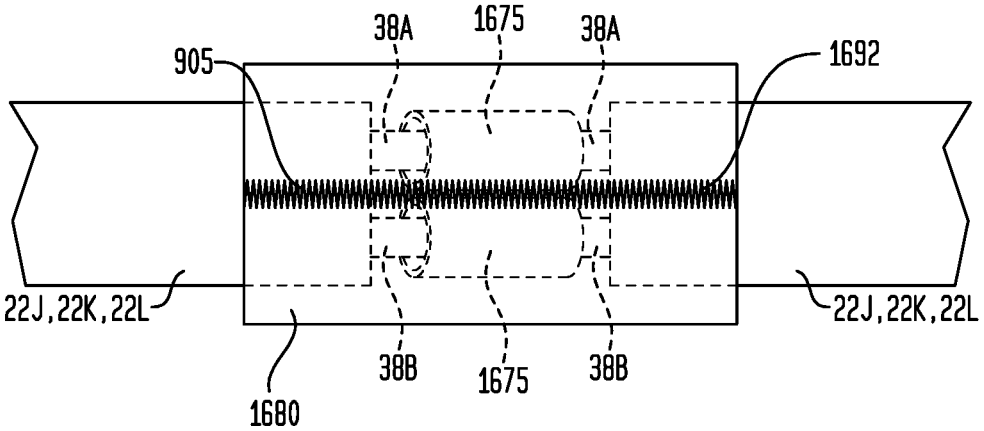

FIG. 31 is an isometric view of an exemplary or representative capping reinforcement of the embedded wire cables of the first, second and third embodiments of a self-locking carrying strap.

Figure 32:
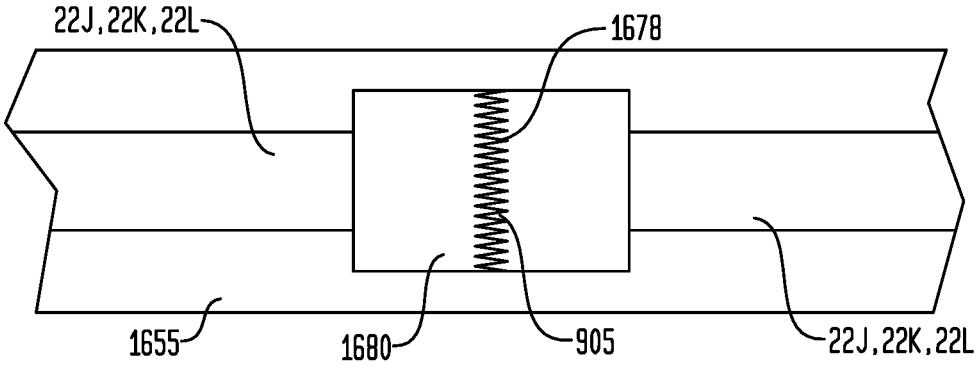

FIG. 32 is a plan view of an exemplary or representative capping reinforcement of the embedded wire cables of the first, second and third embodiments of a self-locking carrying strap secured within the strap channel of the exemplary or representative carrying bags of FIGS. 8 and 15.

Figure 33:
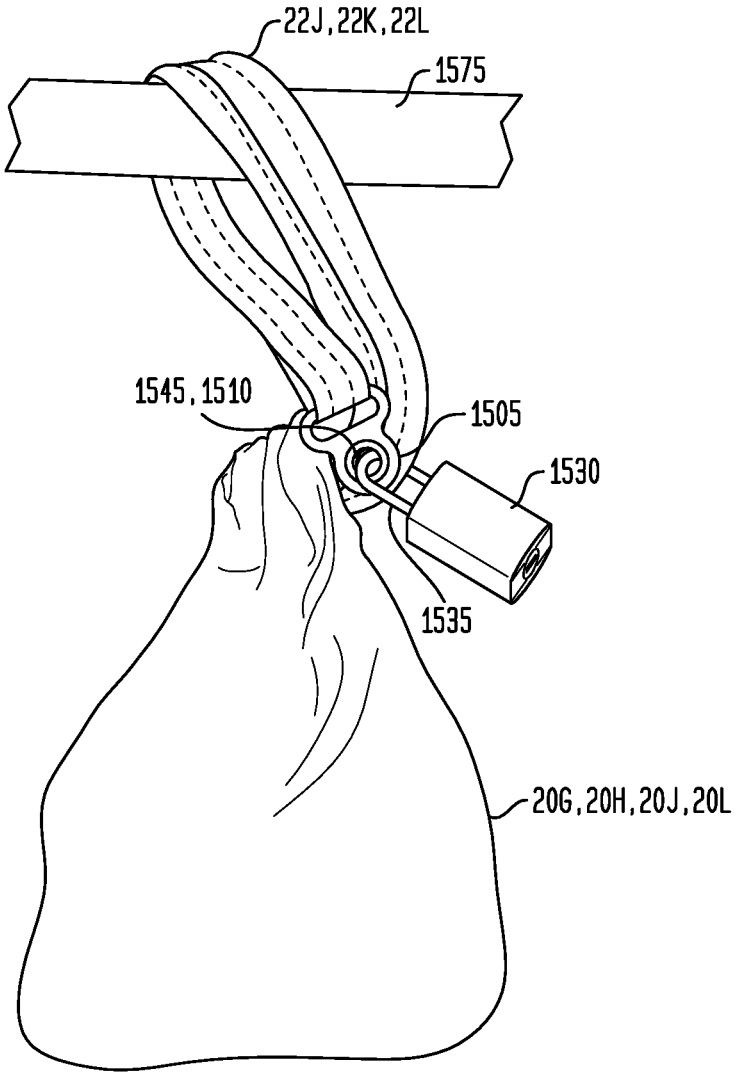

FIG. 33 is an isometric view of the exemplary or representative carrying bags of FIGS. 3, 8, 15 and 34 illustrated in a closed configuration and a locked arrangement.

FIG. 34 is an isometric front view of an exemplary or representative embodiment of a carrying bag in an open configuration, having an additional embodiment of a security panel assembly forming the body and exterior of the bag and having an exemplary or representative third exterior pocket.

DETAILED DESCRIPTION OF REPRESENTATIVE EMBODIMENTS

While the present invention is susceptible of embodiment in many different forms, there are shown in the drawings and will be described herein in detail specific exemplary embodiments thereof, with the understanding that the present disclosure is to be considered as an exemplification of the principles of the invention and is not intended to limit the invention to the specific embodiments illustrated. In this respect, before explaining at least one embodiment consistent with the present invention in detail, it is to be understood that the invention is not limited in its application to the details of construction and to the arrangements of components set forth above and below, illustrated in the drawings, or as described in the examples. Methods and apparatuses consistent with the present invention are capable of other embodiments and of being practiced and carried out in various ways. Also, it is to be understood that the phraseology and terminology employed herein, as well as the abstract included below, are for the purposes of description and should not be regarded as limiting.

Reference is made to the following patent applications, the entire contents of which are incorporated herein by reference with the same full force and effect as if set forth in their entirety herein: U.S. patent application Ser. No. 15/879,149, filed concurrently herewith; U.S. Provisional Patent Application No. 62/450,405, filed Jan. 25, 2017; U.S. patent application Ser. No. 15/817,610, filed Nov. 20, 2017; U.S. patent application Ser. No. 15/821,383, filed Nov. 22, 2017; U.S. patent application Ser. No. 14/641,173, filed Mar. 6, 2015; and U.S. patent application Ser. No. 15/624,171, filed Jun. 15, 2017, which is a continuation of U.S. patent application Ser. No. 14/641,206, filed Mar. 6, 2015; and U.S. Provisional Patent Application No. 61/949,452, filed Mar. 7, 2014.

Figure 1:
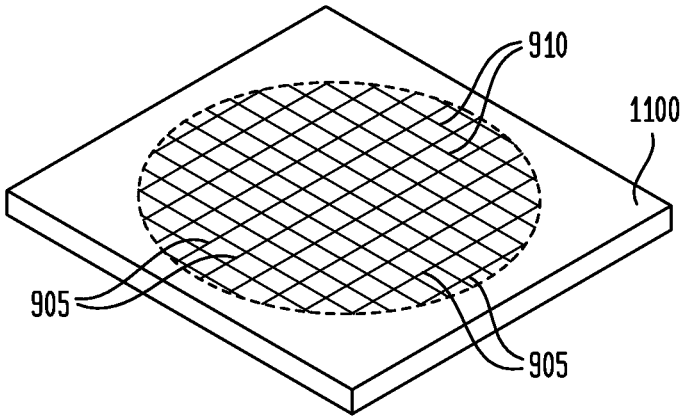
FIGS. 1 and 2 are isometric views illustrating representative nonmetallic, cut-resistant yarn or fiber-based embodiments of security panel assemblies.
Figure 2:
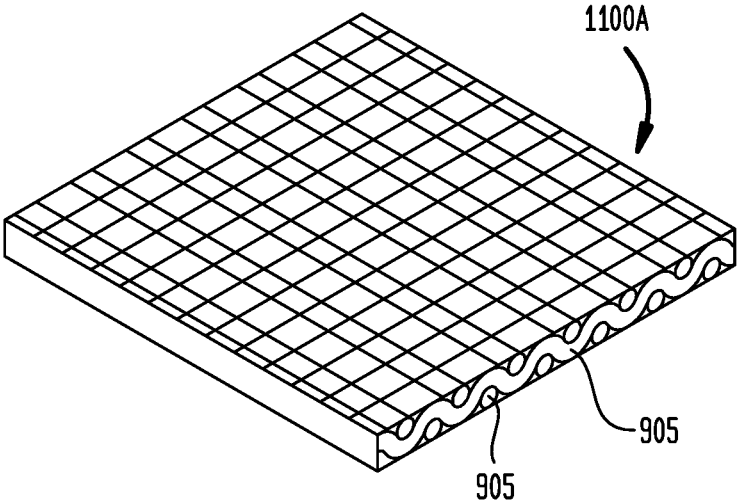

FIGS. 1 and 2 are isometric views illustrating various additional and representative embodiments of security panel assemblies 1100, 1100A, which may be either metallic or nonmetallic, fiber-based security panel assemblies. Instead of utilizing a metallic wire or cable to form a wire matrix, for these representative security panel assemblies 1100, 1100A, a non-metallic, substantially cut-resistant polymer-based fiber, thread or yarn (individually and collectively referred to as a "fiber") 905 is utilized, such as a Kevlar® aramid fiber, thread or yarn available from DuPont of Wilmington, Del. US, or a Vectran® liquid crystal polymer multifilament fiber, thread or yarn available from Kuraray America Inc. of Houston, Tex. US. Referring to FIGS. 1 and 2, a security panel assembly 1100 is a substantially cut-resistant fabric comprising a plurality of interwoven, spun, blown, or otherwise embedded or linked, substantially cut-resistant polymer-based fibers, threads or yarns 905. For the security panel assembly 1100 as illustrated, the spaced-apart fibers 905 form a fiber matrix 910, and may be interwoven with other types of threads, yarns or fibers.

In addition, this fiber matrix 910 may also be included or embedded in the webbing (e.g., 527, 528) utilized to form a substantially cut-resistant carry strap 22J, 22K, 22L. For such embodiments, the cut-resistant yarn or fiber 905 is typically woven with the other fiber material comprising the webbing during manufacture. Also for such embodiments, an additional cut-resistant cable 38 may not be required to provide the desired level of security.

Combinations of different types of material may also be utilized to form the various fibers 905. For example and without limitation, a cut-resistant fiber may be combined with metallic or carbon fibers or threads, or elastic or rubber fibers or threads, in any of various combinations, such as a combination of steel and polymer.

Any type of weaving, braiding or knitting may be utilized, and as illustrated in FIG. 2, a security panel assembly 1100A is a substantially cut-resistant, knitted fabric comprising a plurality of abutting, knitted and substantially cut-resistant polymer-based fibers, threads or yarns 905. In addition to being knitted rather than woven, the security panel assembly 1100A generally comprises little to no other types of threads or fibers, such that the cut-resistant fibers 905 are substantially abutting in the security panel assembly 1100A.

Figure 3:
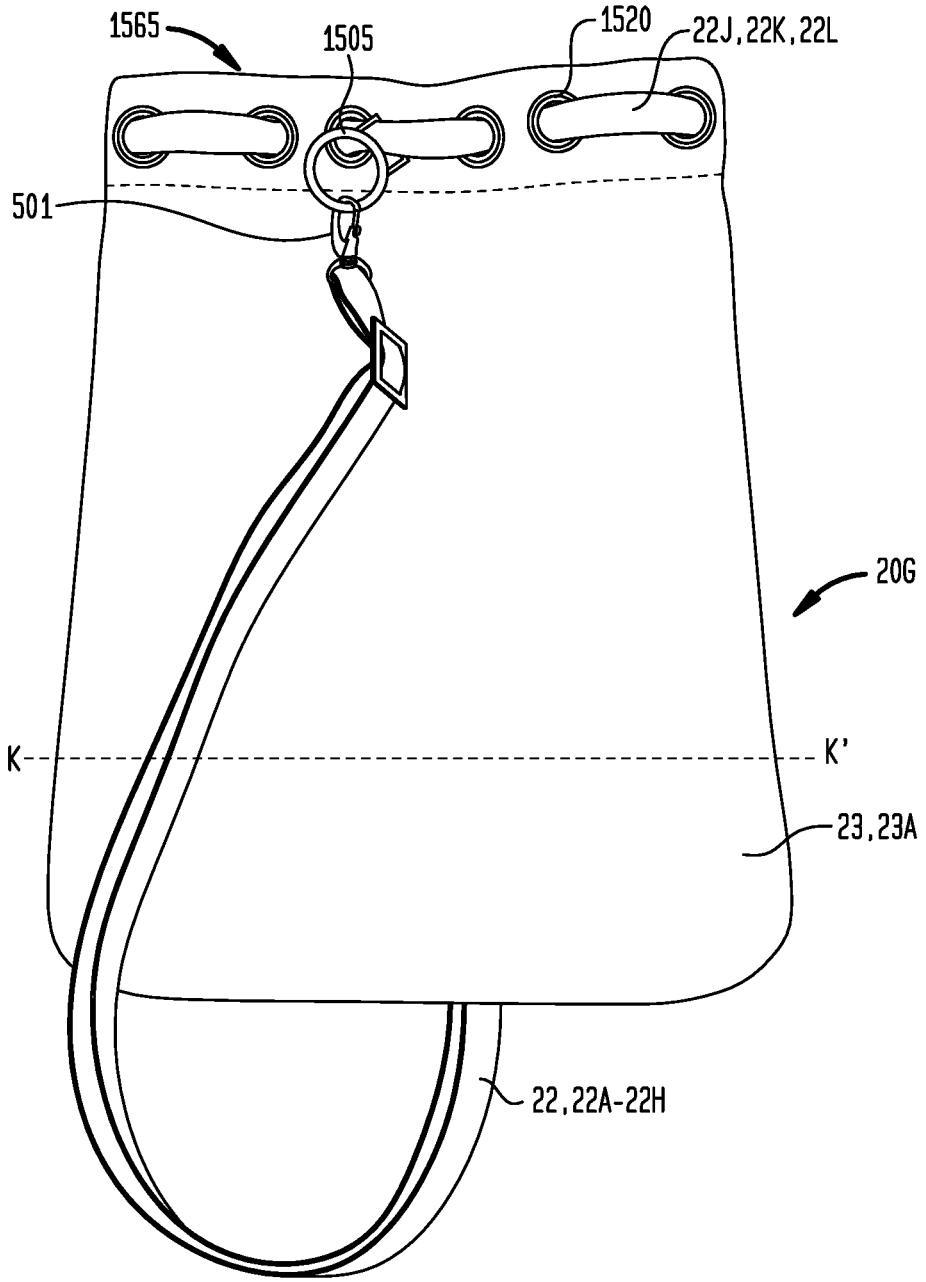
FIG. 3 is a front plan view of an exemplary or representative embodiment of a carrying bag in an open configuration and having additional representative embodiments of a security panel assembly.
Figure 4:
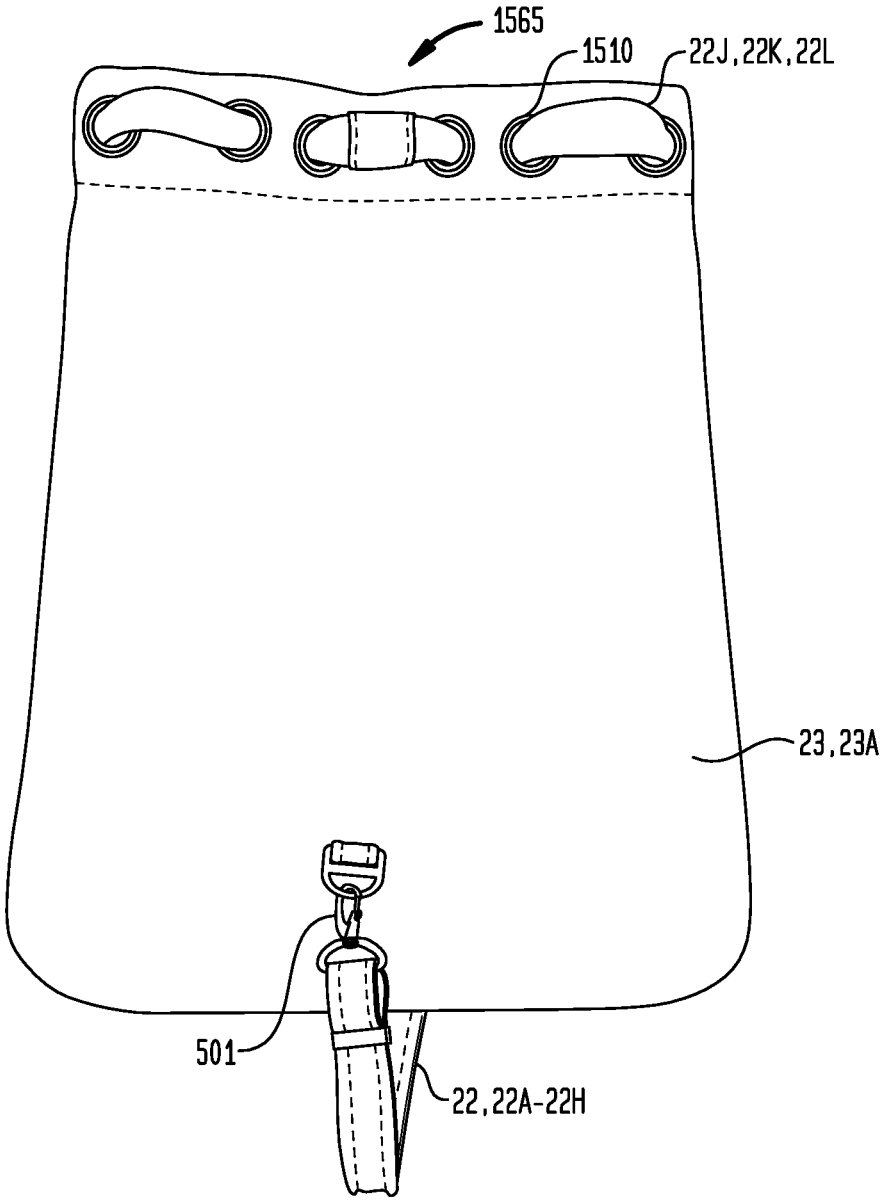
FIG. 4 is a rear plan view of an exemplary or representative embodiment of a carrying bag in an open configuration and having additional representative embodiments of a security panel assembly.
Figure 5:
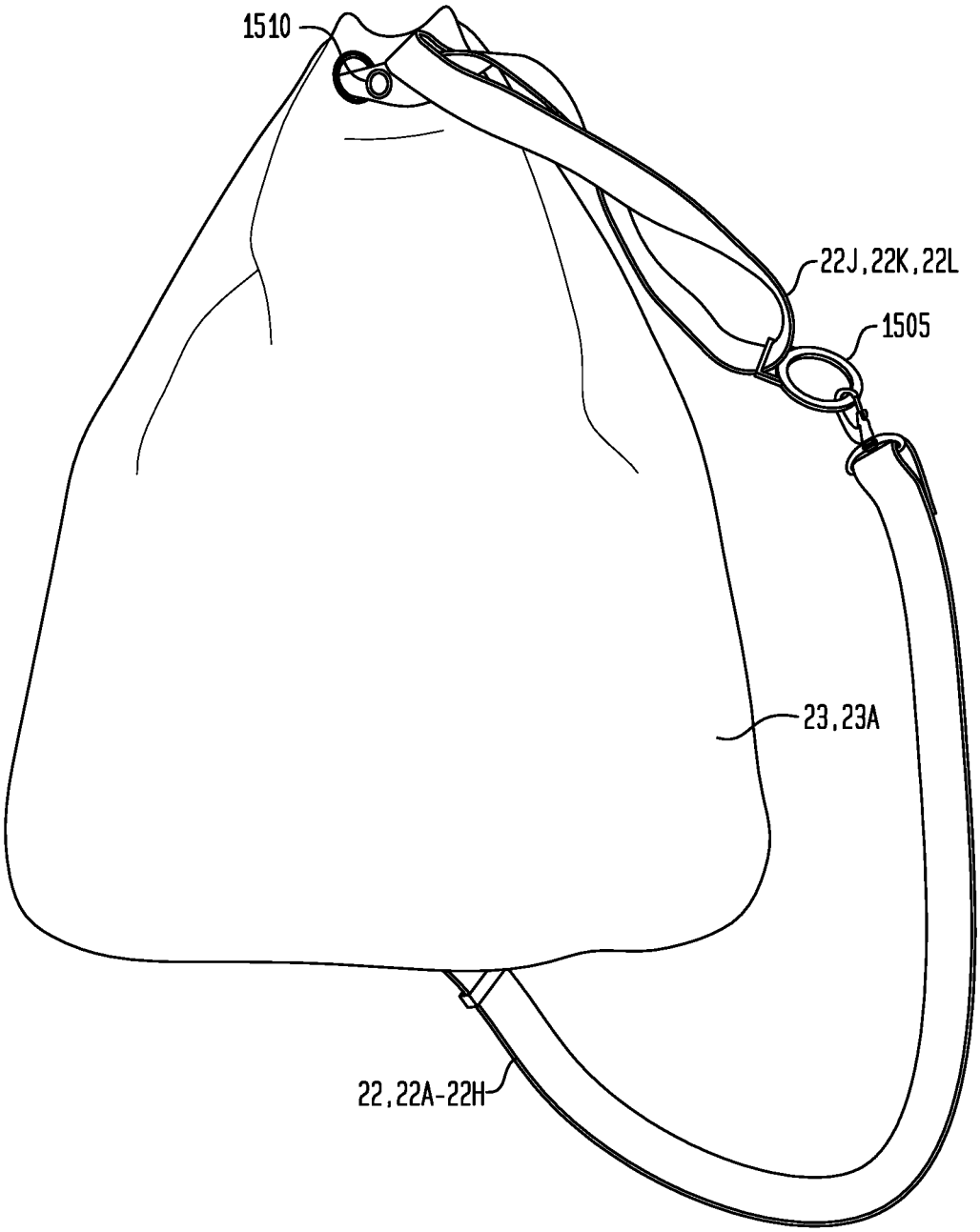
FIG. 5 is a front plan view of an exemplary or representative embodiment of a carrying bag in a closed configuration and having additional representative embodiments of a security panel assembly.
Figure 6:
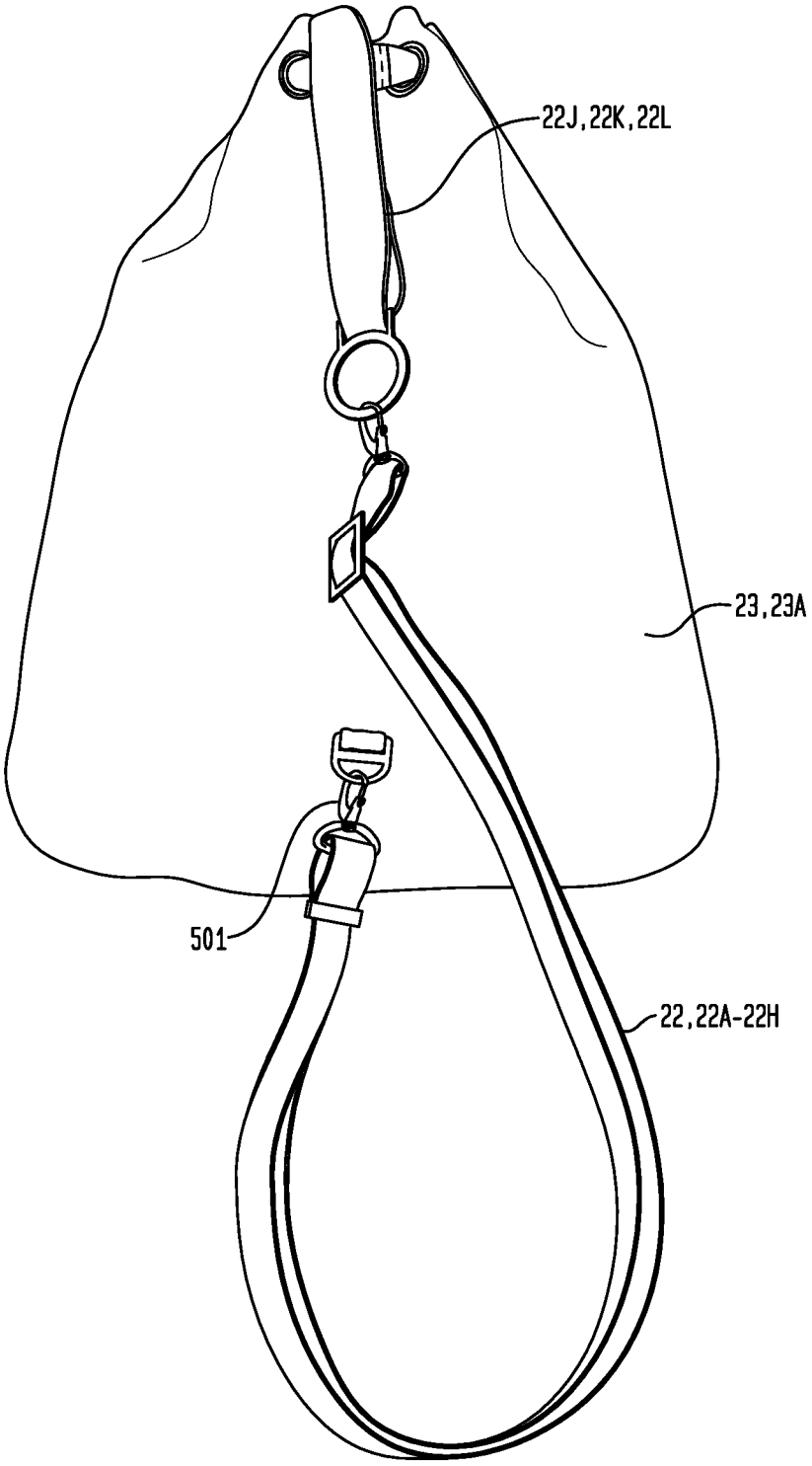
FIG. 6 is a rear plan view of an exemplary or representative embodiment of a carrying bag in a closed configuration and having additional representative embodiments of a security panel assembly.
Figure 7:
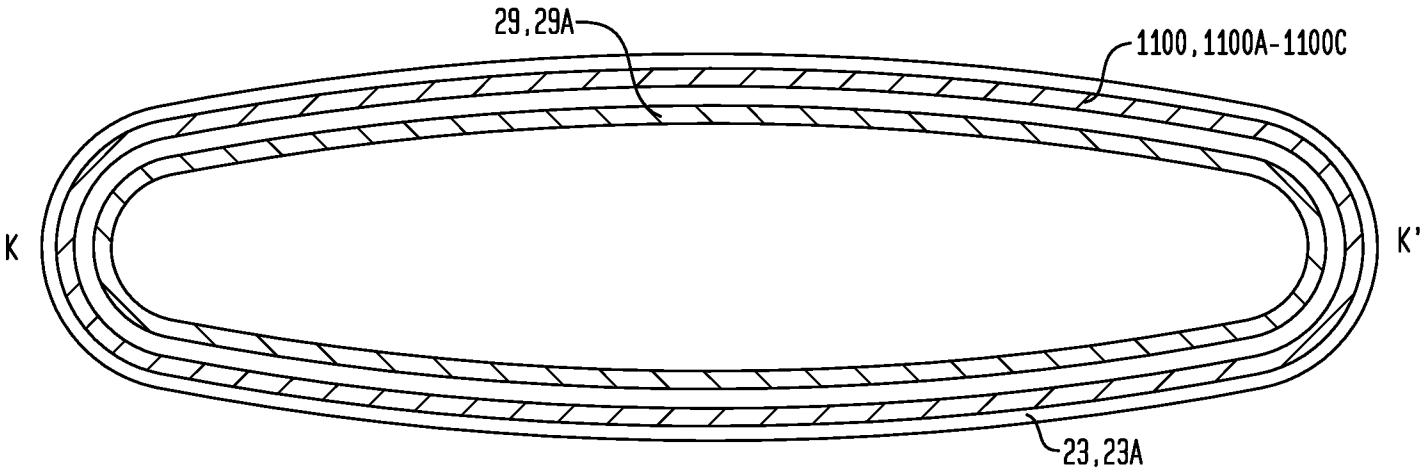
FIG. 7 is a cross-sectional view (through the K-K' plane) of the representative carrying bag of FIG. 3 having the additional embodiment of a security panel assembly.

FIGS. 3 and 4 are front and rear plan views of an exemplary or representative embodiment of a carrying bag 20G in an open configuration and having additional representative embodiments of a security panel assembly 1100, 1100A-1100C. FIGS. 5 and 6 are front and rear plan views of the exemplary or representative embodiment of a carrying bag 20G in a closed configuration and having additional representative embodiments of a security panel assembly 1100, 1100A-1100C. FIG. 7 is a cross-sectional view (through the K-K' plane) of the representative carrying bag 20 G of FIG. 3 having the additional embodiment of a security panel assembly 1100, 1100A-1100C. It should be noted that "carrying" and "carry" are utilized interchangeably herein, such that "carrying" bag 20G, 20H, 20K means and refers to "carry" bag 20G, 20H, 20K, and vice-versa, and "carrying" strap 22J, 22K, 22L means and refers to "carry" strap 22J, 22K, 22L, and vice-versa.

Referring to FIGS. 3-7, the representative carry bag 20G includes a security panel assembly 1100, 1100A-1100C in a similar or the same arrangement or construction as the expansion panel 815, but extended to the entire carry bag 20G and not limited to only an expansion panel 815 portion of a bag. The representative carry bag 20G comprises an exterior bag 23, 23A, such as a fabric or leather material, e.g., canvas, ballistic nylon, etc., and may have any shape or size, as discussed above; an optional lining 29, 29A arranged in the interior of the carry bag 20G; and a security panel assembly 1100, 1100A-1100C arranged between the exterior bag 23, 23A and the lining 29, 29A. When a lining 29, 29A is not included in the carry bag 20G, then the security panel assembly 1100, 1100A-1100C is arranged in the interior of the carry bag 20G and next to or spaced-apart from (e.g., abutting or adjacent, with or without spacing) the exterior bag 23, 23A. The representative carry bag 20G also includes a first carry strap 22J, 22K, 22L, described in greater detail below, and a second carry strap which may be any of the various carry strap embodiments 22, 22A-22H of the incorporated patent applications. Not separately illustrated, one or more interior or exterior pockets may also be included with the representative carry bag 20G. The carry strap 22J, 22K, 22L is utilized to cinch the carry bag 20G into a closed configuration, closing the top or upper opening 1565 as illustrated in FIGS. 5 and 6, and to lock the bag, locking the carry strap 22J, 22K, 22L, to itself and to other objects, as discussed in greater detail below and as illustrated in FIG. 33.

Figure 9:
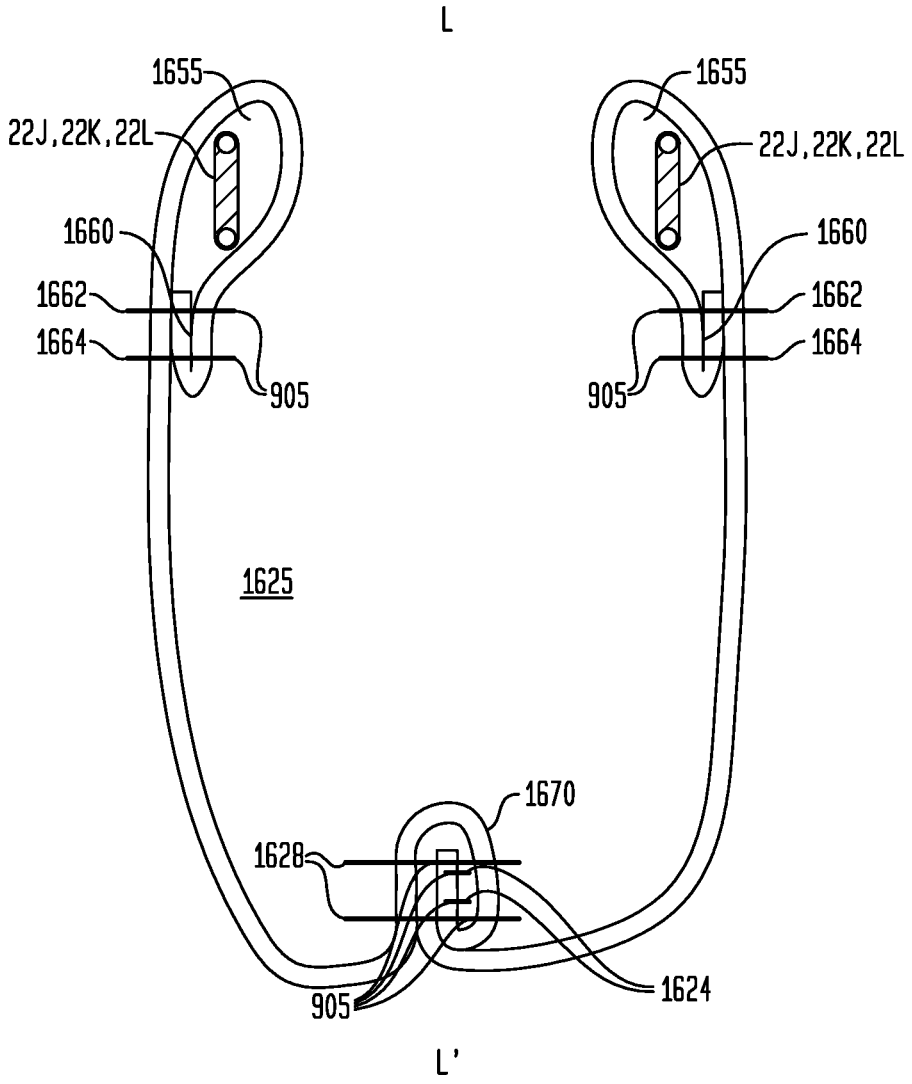
FIG. 9 is a cross-sectional view (through the L-L' plane) of the representative carrying bag of FIG. 8 and having the additional embodiment of a security panel assembly forming the body and exterior of the bag.
Figure 10:
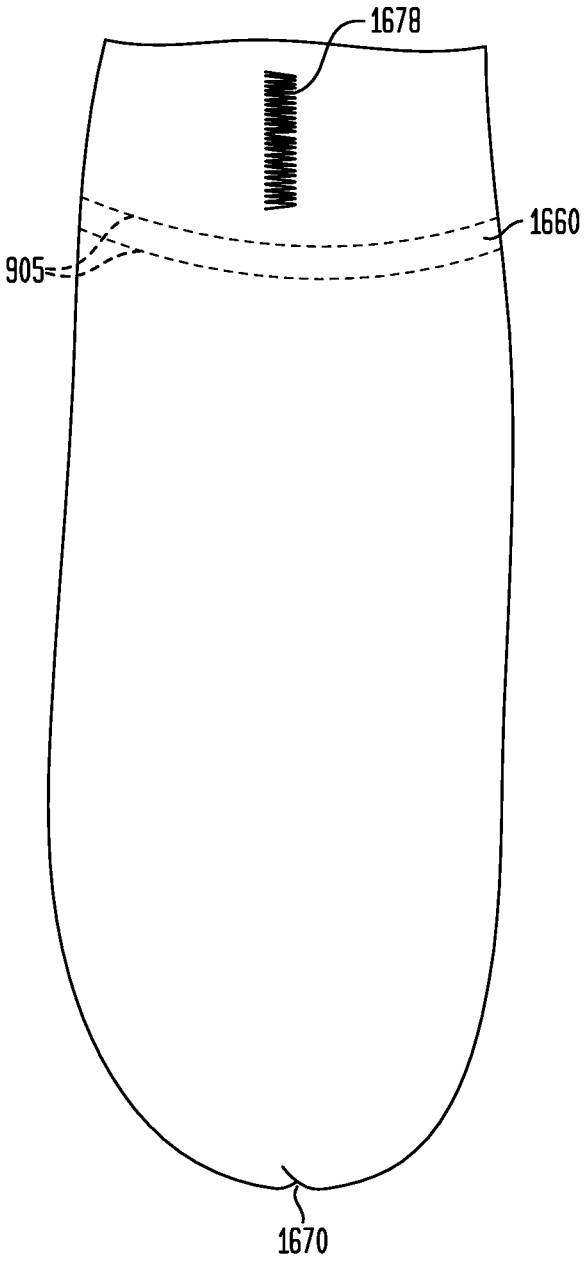
FIG. 10 is a side view of the representative carrying bag of FIG. 8 and having the additional embodiment of a security panel assembly forming the body and exterior of the bag.
Figure 11:
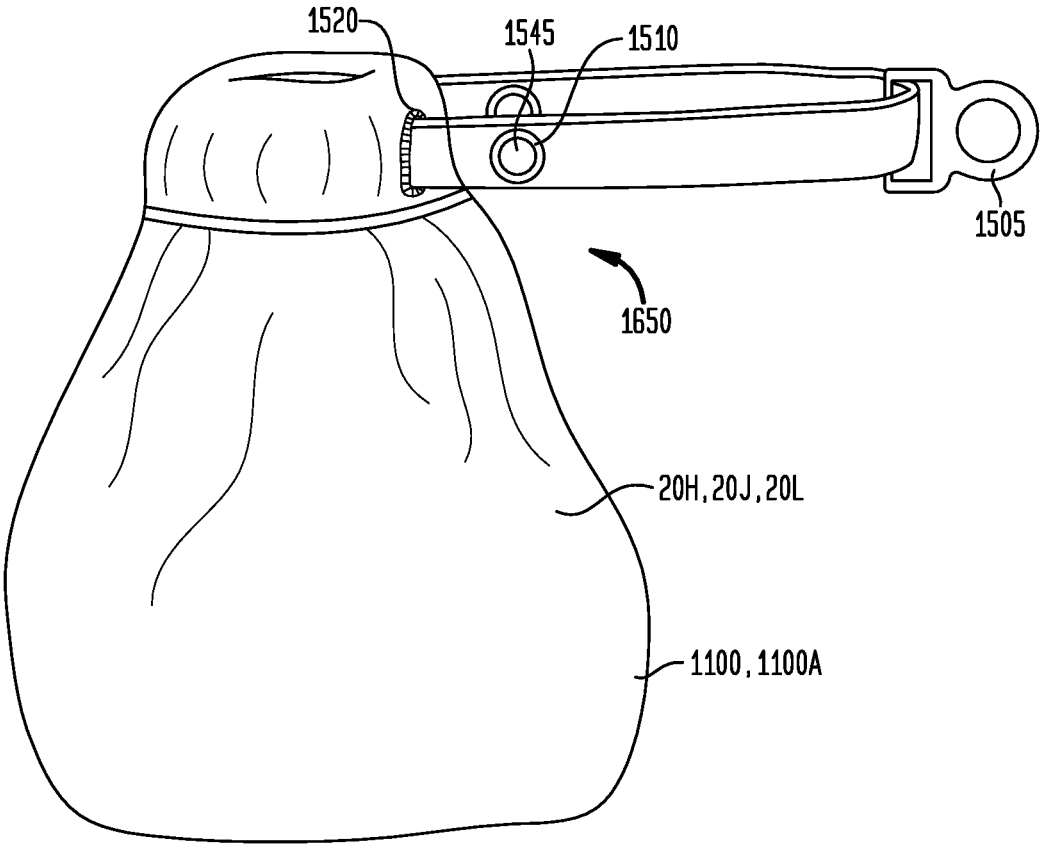
FIG. 11 is an isometric front view of the representative carrying bags of FIGS. 8 and 13-19 in a closed configuration and having an additional embodiment of a security panel assembly forming the body and exterior of the bag.
Figure 12:
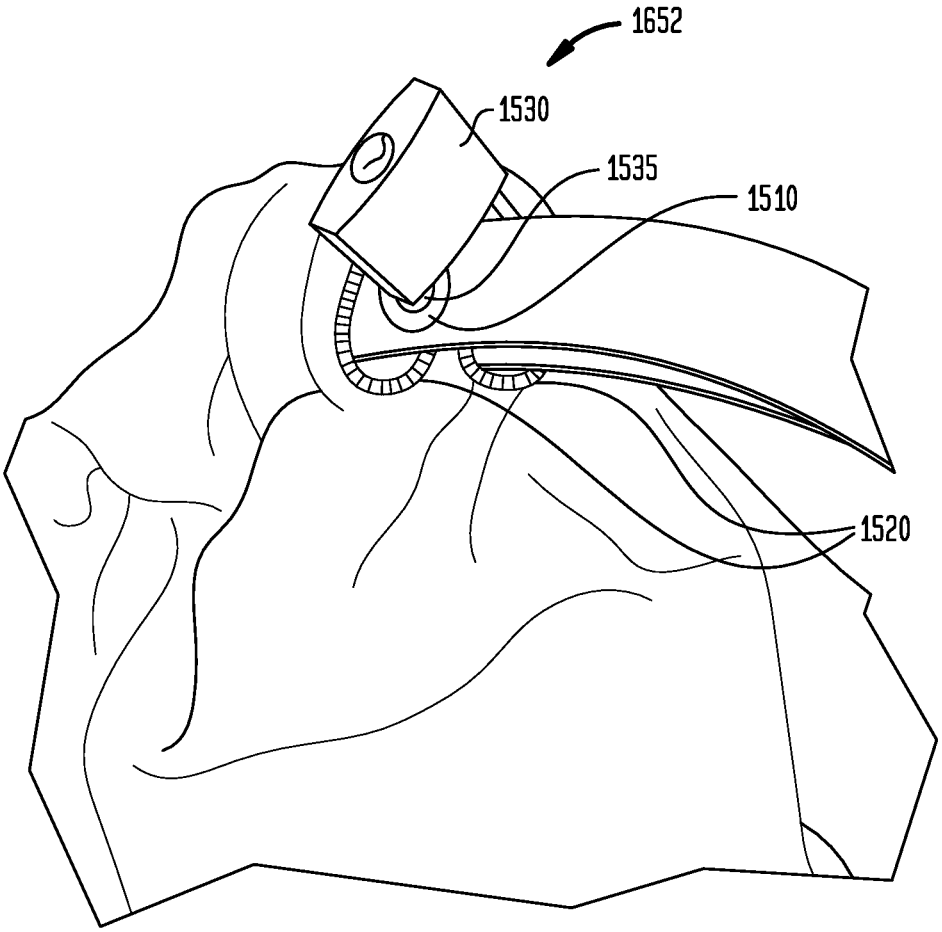
FIG. 12 is an isometric front view of the representative carrying bags of FIGS. 8 and 13-19 in a closed and locked configuration and having an additional embodiment of a security panel assembly forming the body and exterior of the bag.
Figure 13:
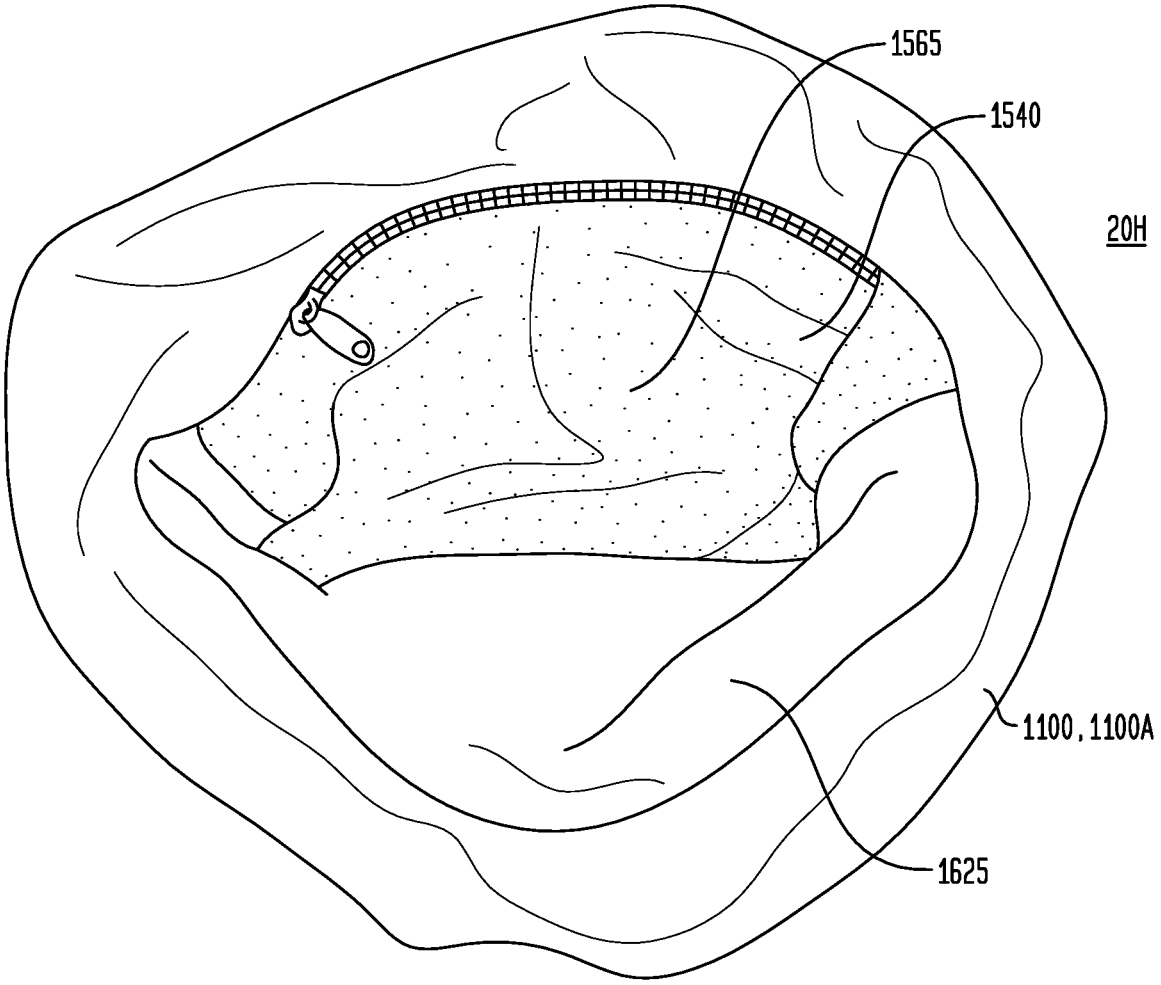
FIGS. 13 and 14 are isometric top and side views of the exemplary or representative embodiment of a carrying bag in an open configuration having an additional embodiment of a security panel assembly forming the body and exterior of the bag and with an exemplary or representative first interior pocket having a zipper fastener.
Figure 14:
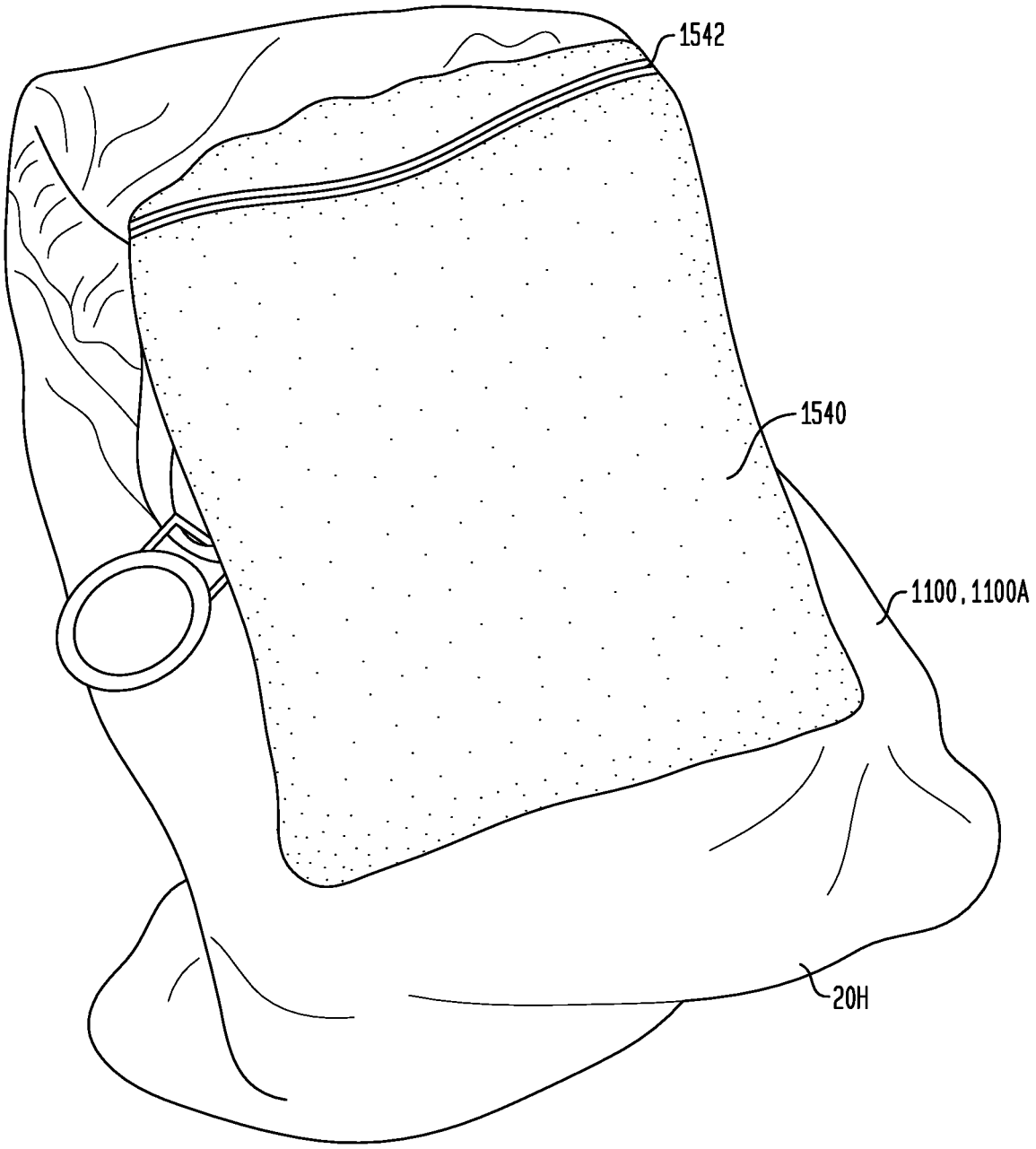

FIG. 8 is an isometric front view of an exemplary or representative embodiment of a carrying bag 20H in an open configuration 1665, allowing entry into the interior 1625 of the bag 20H through the top or upper opening 1565, and having an additional embodiment of a security panel assembly 1100, 1100A directly forming the carrying bag body 1501 (and exterior) of the bag 20H, generally without any exterior cover. FIG. 9 is a cross-sectional view (through the L-L' plane of FIG. 8) of the representative carrying bag 20H, to illustrate the locations and types of protected seams 1660, 1670, discussed in greater detail below with reference to FIGS. 23 and 24. FIG. 10 is a side view of the representative carrying bag 20G, to illustrate the securing (coupling 1678) of the capping reinforcement 1680 of the carry strap 22J, 22K, 22L within the strap channel 1655. FIG. 11 is an isometric front view of the representative carrying bags 20H, 20K, 20L in a closed configuration 1650, using the carry strap 22J, 22K, 22L to cinch the top or upper opening 1565 closed to prevent entry into the interior 1625 of the bag 20H, 20K, 20L. FIG. 12 is an isometric front view of the representative carrying bags 20H, 20K, 20L in a closed and locked configuration 1652. FIGS. 13 and 14 are isometric top and side views of the exemplary or representative embodiment of a carrying bag 20H in an open configuration 1665 and with an exemplary or representative first interior pocket 1540 having a zipper fastener 1542. During use, the first interior pocket 1540 is generally designed to be maintained or kept within the interior 1625 of the carrying bag 20H, as illustrated in FIG. 13.

Figure 16:
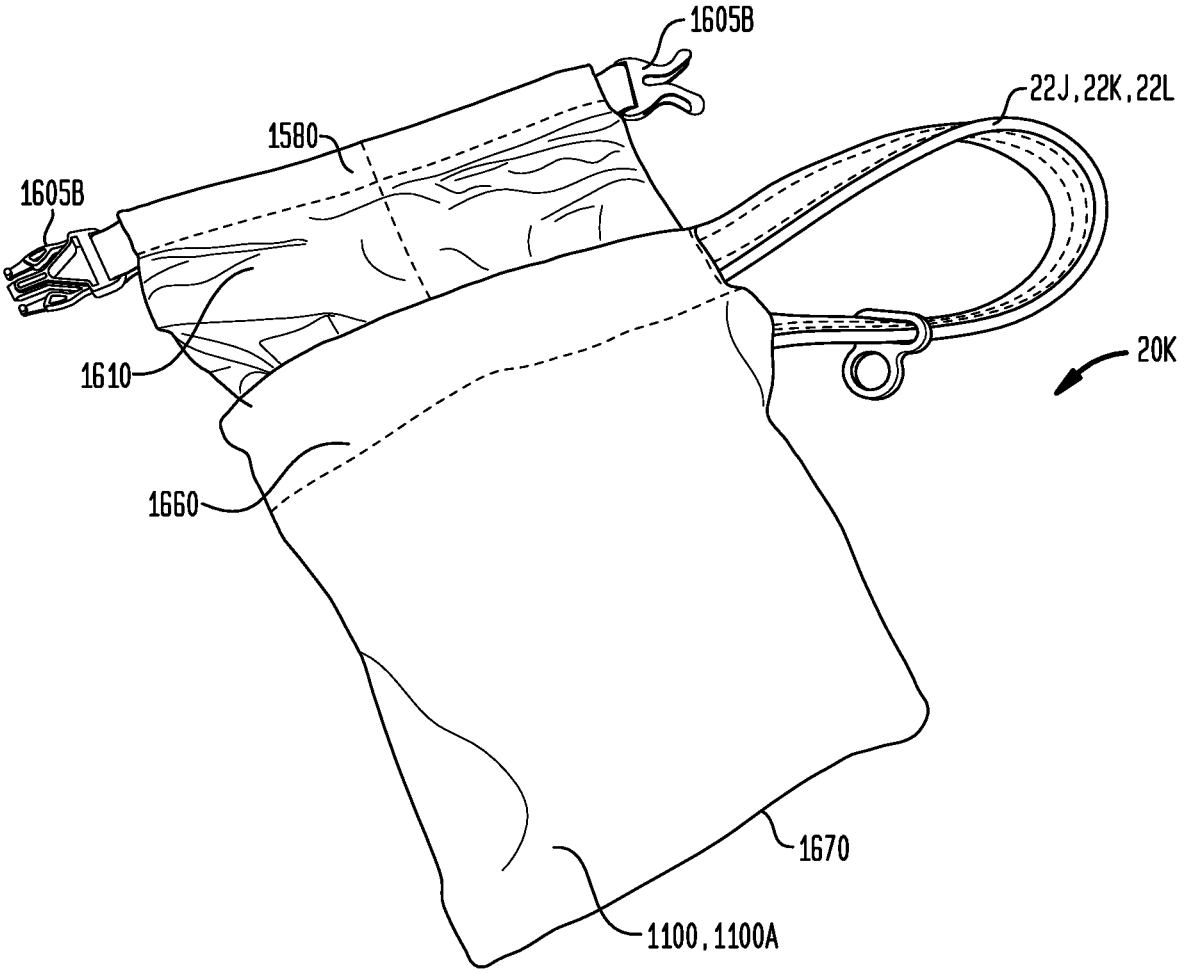
Figure 17:
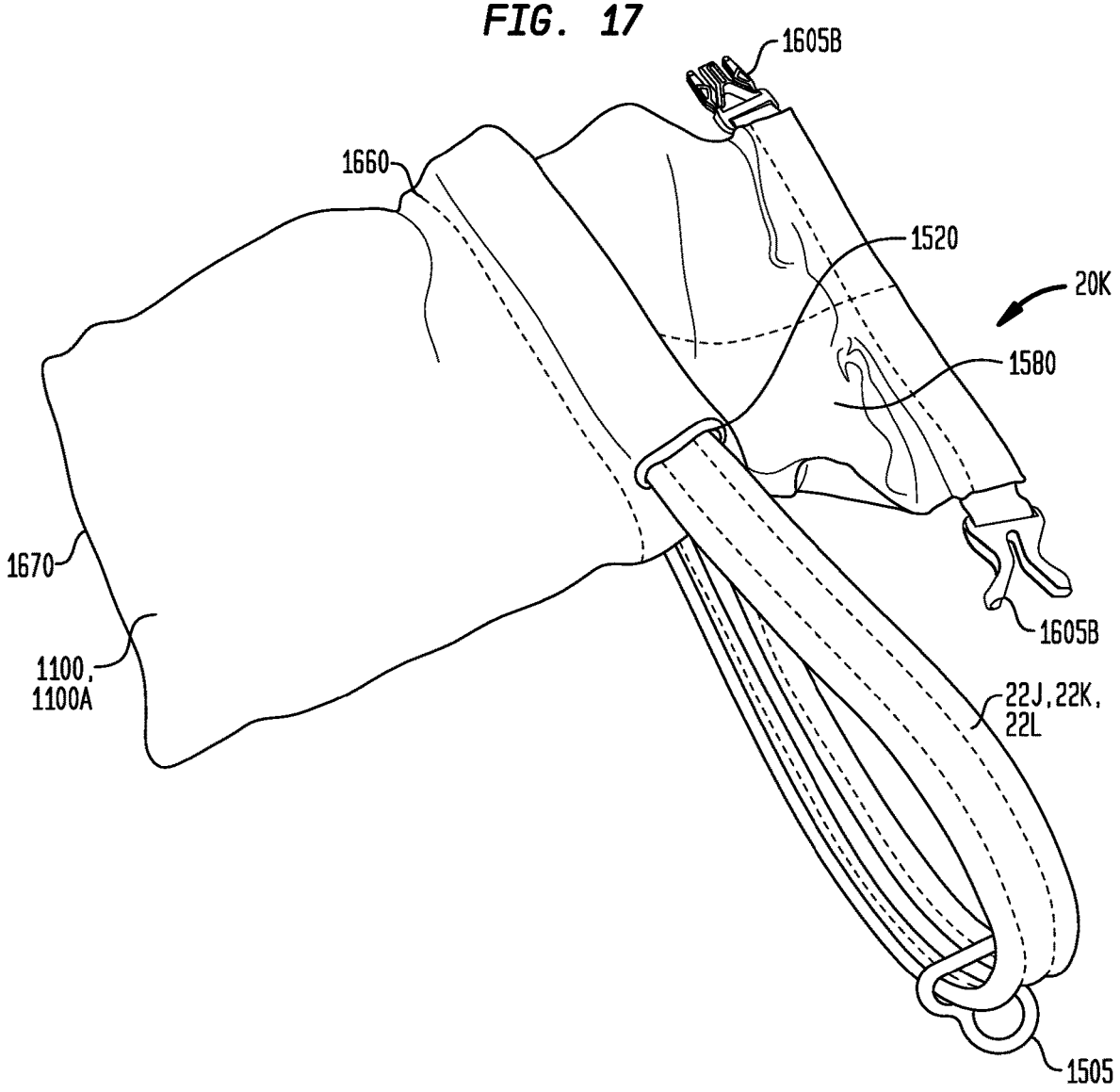
FIG. 17 is an isometric side view of the exemplary or representative embodiment of a carrying bag in an open configuration, having an additional embodiment of a security panel assembly forming the body and exterior of the bag and having an exemplary or representative second interior pocket in an open configuration.

FIGS. 15, 16 and 17 are various isometric views of an exemplary or representative embodiment of a carrying bag 20K in an open configuration 1665, allowing entry into the interior 1625 of the bag 20K through the top or upper opening 1565, and having an additional embodiment of a security panel assembly 1100, 1100A directly forming the carrying bag body 1502 (and exterior) of the carrying bag 20K, generally without any exterior cover, and having an exemplary or representative second interior pocket 1580 in an open configuration 1667. The carrying bag 20K and carrying bag 20H differ from each other with respect to the first and second interior pockets 1540 and 1580 and the anchoring of the pockets within the carrying bags 20H, 20K, and otherwise share many of the same structural elements and details, described in greater detail below for all of the carrying bags 20H, 20K, 20L.

Figure 18:
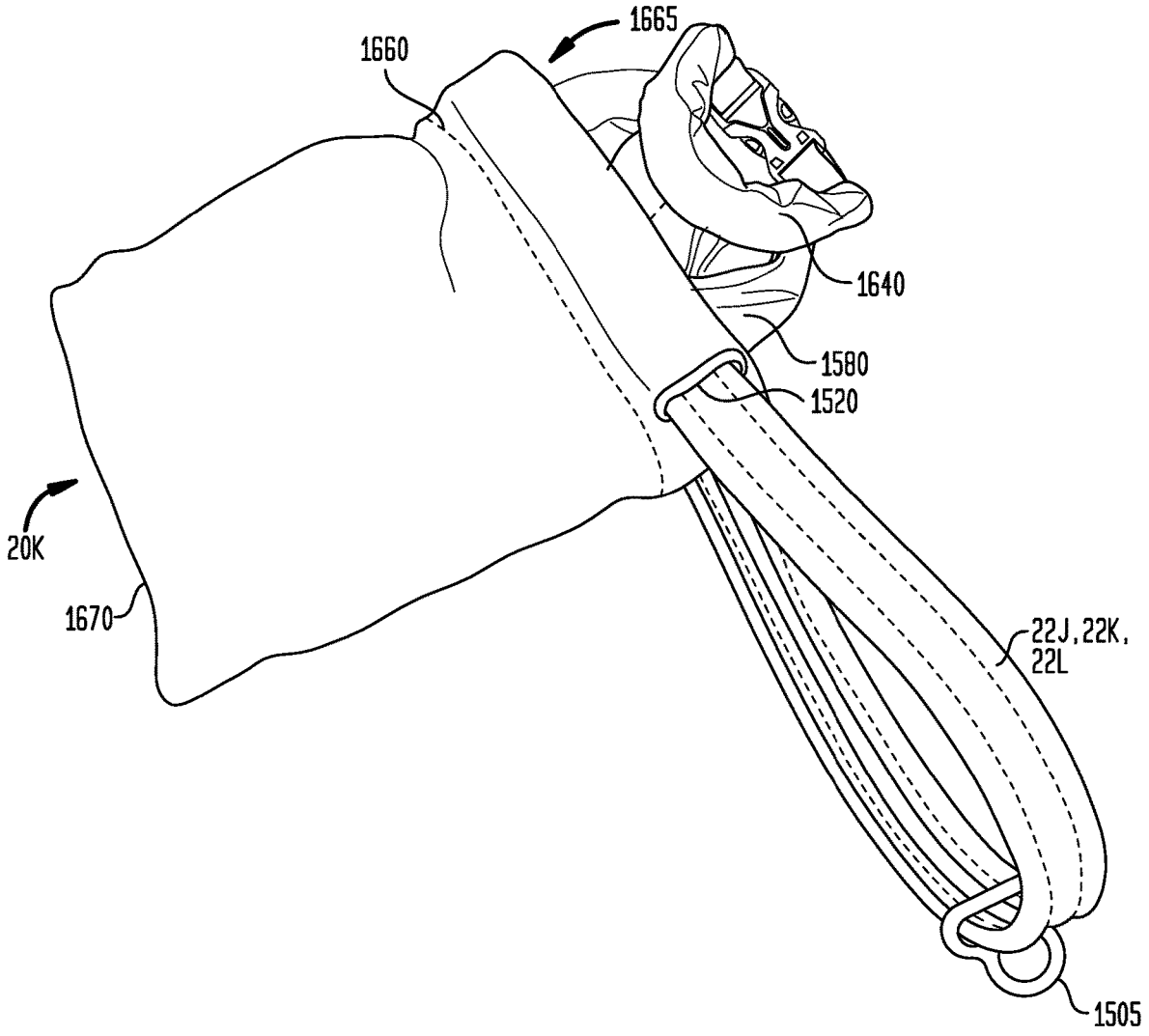
FIG. 18 is an isometric side view of the exemplary or representative carrying bag of FIGS. 15-17 in an open configuration and having the exemplary or representative second interior pocket in a first closed configuration.
Figure 19:
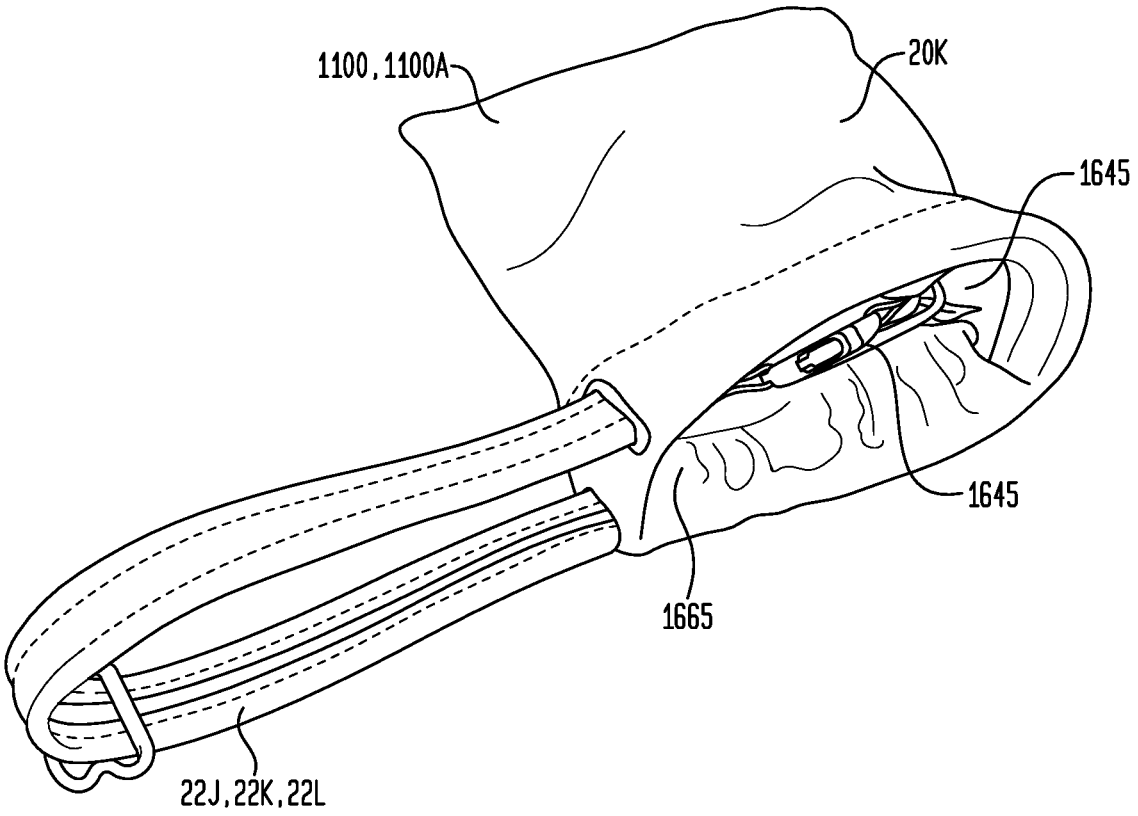
FIG. 19 is an isometric side view of the exemplary or representative carrying bag of FIGS. 15-17 in an open configuration and having the exemplary or representative second interior pocket in a second closed configuration.
Figure 20:
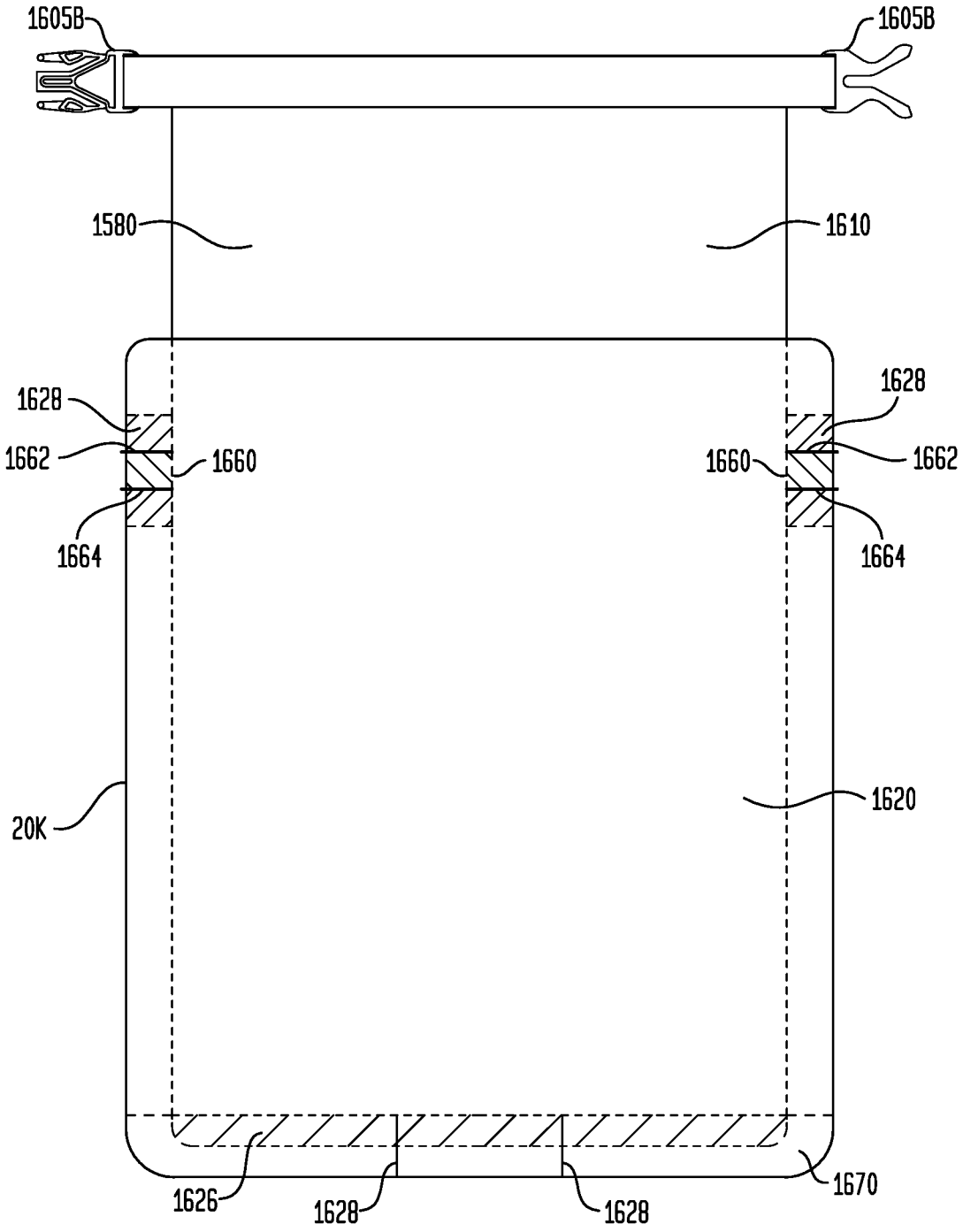
FIG. 20 is a plan, cut-away view of the exemplary or representative carrying bag of FIGS. 15-17 illustrating a first type of attachment of the second interior pocket into the side walls and/or the lower wall or lower seam of the exemplary or representative carrying bag.
Figure 21:
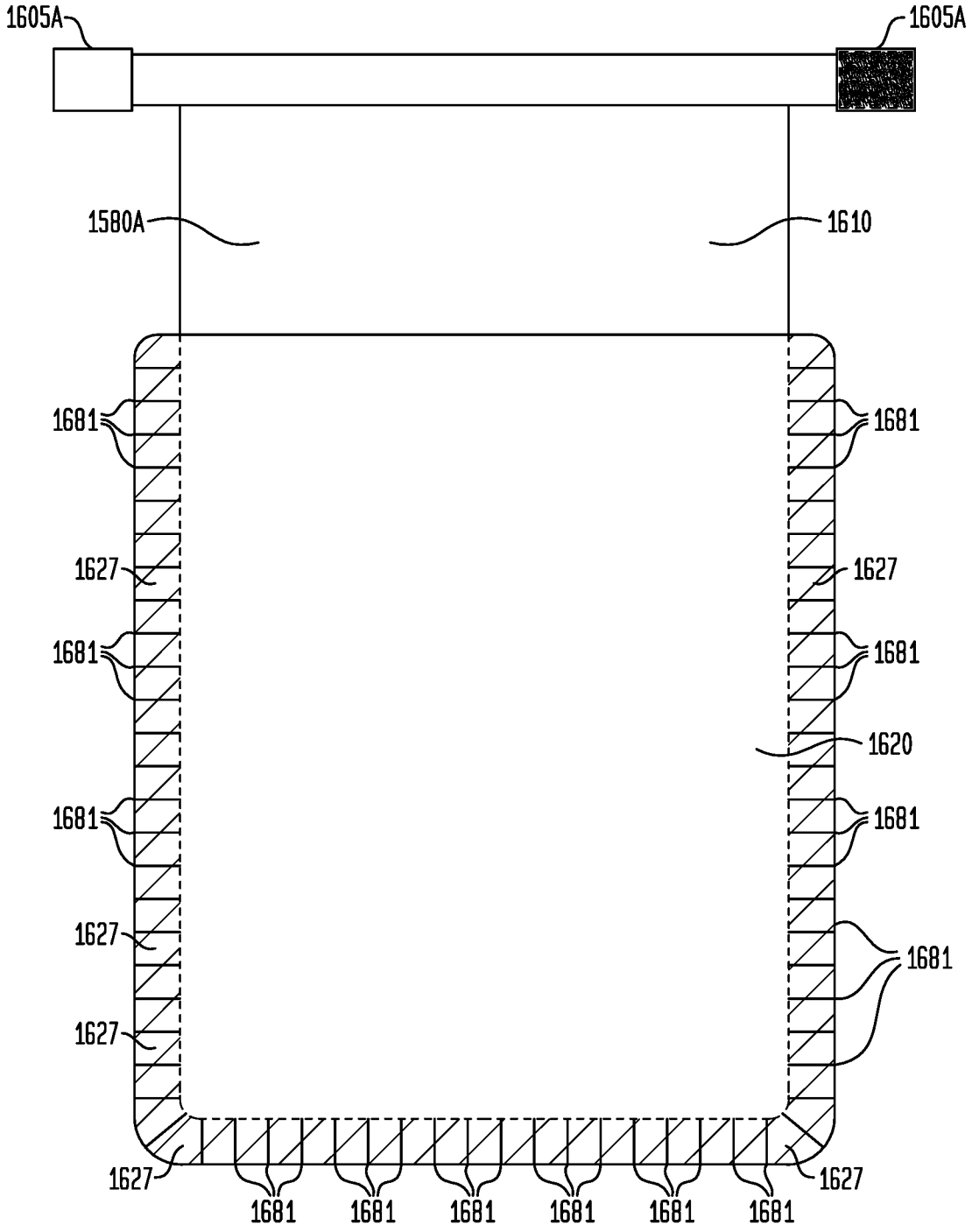
FIG. 21 is a plan, cut-away view of the exemplary or representative carrying bag of FIGS. 15-17 illustrating a second type of attachment of the second interior pocket into the front wall or rear wall of the exemplary or representative carrying bag.
Figure 22:
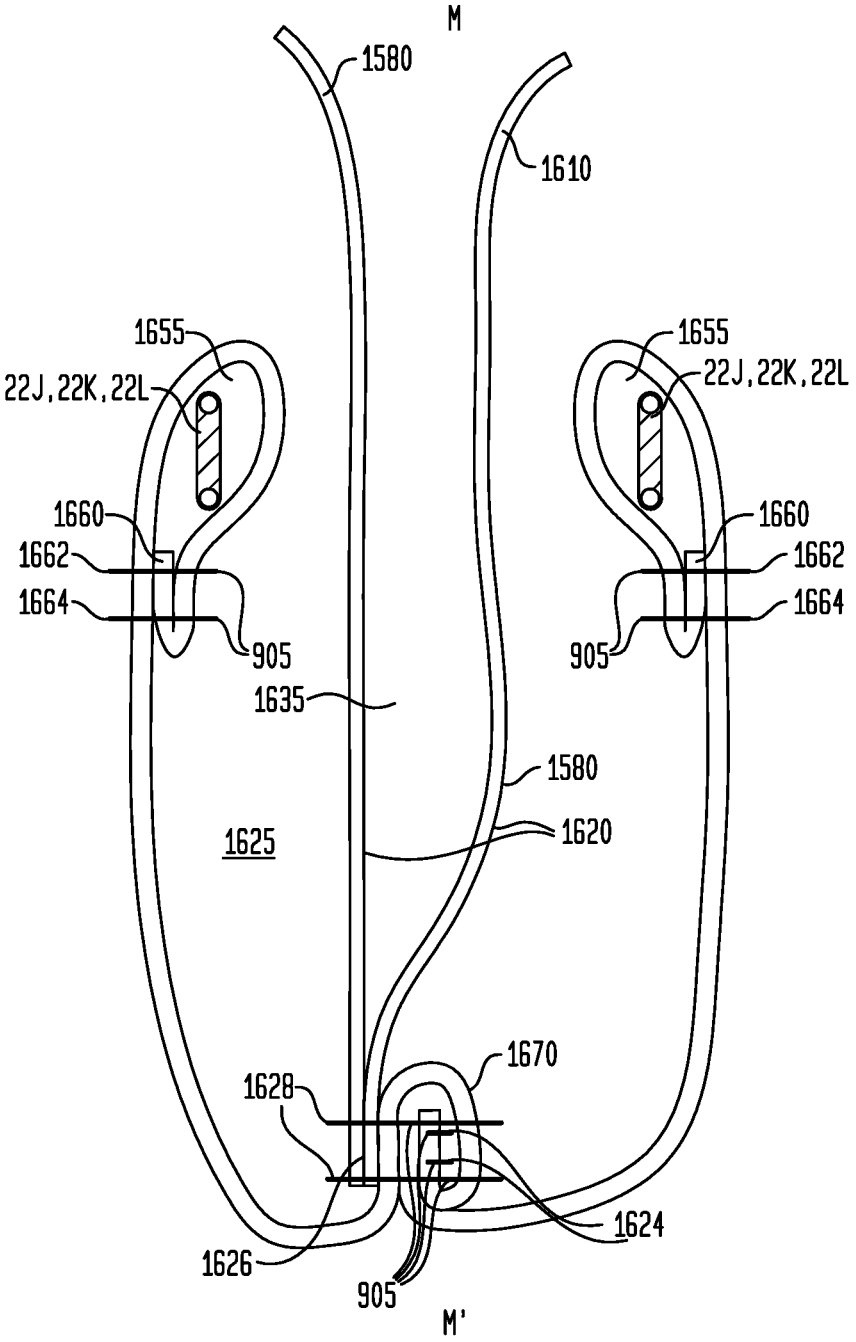
FIG. 22 is a partial cross-sectional view (through the M-M' plane) of the representative carrying bag of FIG. 15 and having the additional embodiment of a security panel assembly forming the body and exterior of the bag.
Figure 23A:
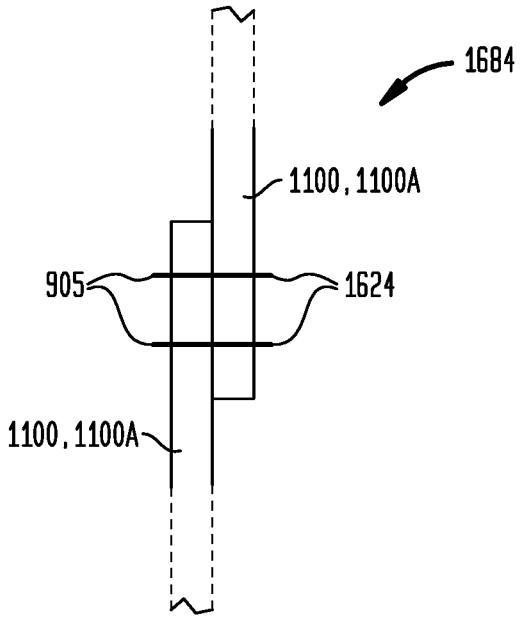
Figure 23B:
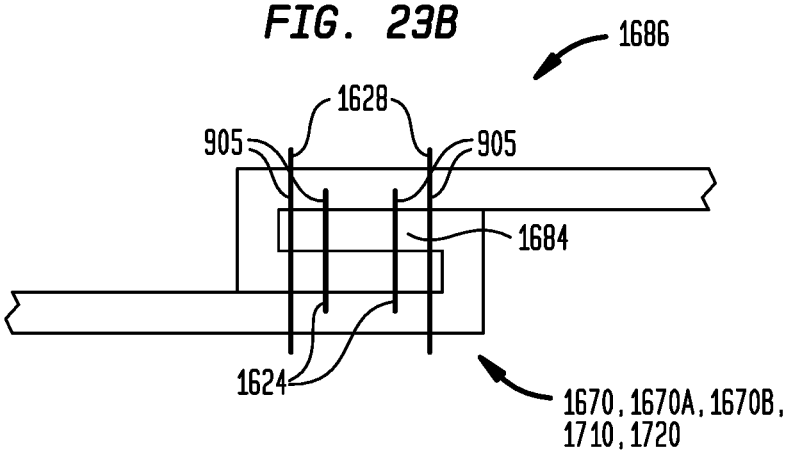
Figure 23C:
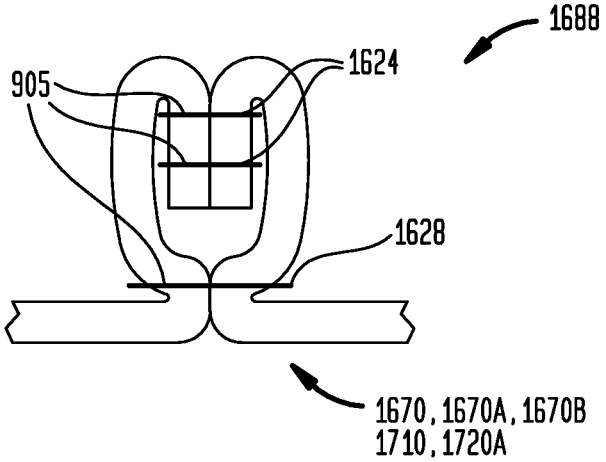
Figure 23D:
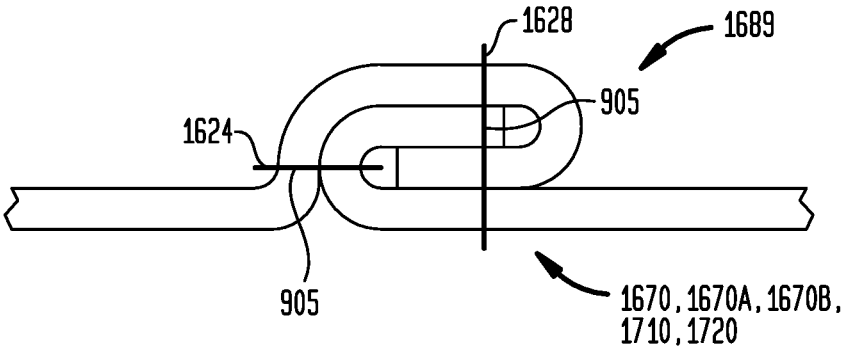

FIG. 18 is an isometric side view of the carrying bag 20K in an open configuration 1665 and having the exemplary or representative second interior pocket 1580 in a first closed configuration 1640. FIG. 19 is an isometric side view of the carrying bag 20K in an open configuration and having the second interior pocket 1580 in a second closed configuration 1645. FIG. 20 is a plan, cut-away view of the carrying bag 20K illustrating a first type of attachment of the second interior pocket 1580 into the side walls and/or the lower wall or second, lower or bottom seam 1670 of the carrying bag 20K. FIG. 21 is a plan, cut-away view of the carrying bag 20K illustrating a second type of attachment of the second interior pocket 1580 into the front wall or rear wall of the exemplary or representative carrying bag 20K. FIG. 22 is a cross-sectional view (through the M-M' plane of FIG. 15) of the carrying bag 20K. FIGS. 23A, 23B, 23C and 23D are cross-sectional views of an exemplary or representative embodiment of a protected second seam 1670, 1670A, 1670B (and also any side seams 1710, 1720) and/or steps in their formation for the carrying bags 20H, 20K, 20L, with FIG. 23B illustrating a double-lapped seam, FIG. 23C illustrating a French seam, and FIG. 23D illustrating a flat felled seam, any of which also may be utilized to form any protected seam 1670, 1670A, 1670B, 1710, 1720, for example and without limitation. FIGS. 24A and 24B are cross-sectional views of exemplary or representative embodiments of a protected first seam 1660 for the carrying bags 20H, 20K, 20L. For example, FIGS. 23B and 24B are cross-sectional views through the M-M' plane of FIG. 15, as example seams which may be utilized to form any of the protected seams 1670, 1670A, 1670B, 1710, 1720.

FIG. 25 is an isometric view of exemplary or representative first, second and third embodiments of a self-locking carrying strap 22J, 22K, 22L. FIG. 26 is a cut-away plan view of an exemplary or representative first embodiment of a self-locking carrying strap 22J. FIG. 27 is a first cross-sectional view (through the N-N' plane of FIG. 25) of the exemplary or representative first and second embodiments of a self-locking carrying strap 22J, 22K. FIG. 28 is a second cross-sectional view (through the P-P' plane of FIG. 25) of the exemplary or representative second embodiment of a self-locking carrying strap 22K. FIG. 29 is a third cross-sectional view (through the N-N' plane of FIG. 25) of the exemplary or representative third embodiment of a self-locking carrying strap 22L. FIG. 30 is an isometric view of an exemplary or representative crimping or other coupling (crimps 1675) of embedded wire cables 38A, 38B of the first, second and third embodiments of a carrying strap 22J, 22K, 22L. FIG. 31 is an isometric view of an exemplary or representative capping reinforcement 1680 of the embedded wire cables 38A, 38B of the first, second and third embodiments of a carrying strap 22J, 22K, 22L. FIG. 32 is a plan view of an exemplary or representative capping reinforcement 1680 of the embedded wire cables of the first, second and third embodiments of a self-locking carrying strap 22J, 22K, 22L secured within the strap channel 1655 of the exemplary or representative carrying bags 20H, 20K, 20L. FIG. 33 is an isometric view of the exemplary or representative carrying bags 20H, 20K, 20L illustrated in a closed configuration and a locked arrangement.

FIG. 34 is an isometric front view of an exemplary or representative embodiment of a carrying bag 20L in an open configuration 1665, allowing entry into the interior 1625 of the bag 20L through the top or upper opening 1565, having an additional embodiment of a security panel assembly 1100, 1100A directly forming the carrying bag body 1503 (and exterior) of the bag, generally without any exterior cover, having an exemplary or representative second interior pocket 1580A in an open configuration 1667, and having an exemplary or representative third exterior pocket 1705. The carrying bag 20L is illustrated to show examples of many of the variations and optional features which may be included in any of the carrying bags 20H, 20K, 20L. In addition to the differences between the carrying bags 20H and 20K discussed above, the carrying bag 20L differs from the carrying bags 20H, 20K with respect to having multiple protected side seams 1710, 1720 (which may have any of the protected seam 1670, 1670A, 1670B, 1710, 1720 configurations) and multiple protected lower (bottom) seams 1670A, 1670B, having a third pocket 1705 accessible from the exterior through a zipper fastener 1725 having a locking zipper pull 1730, a locking ring 1505A having a rectangular form factor, and having hook and loop fasteners 1605A for the second pocket 1580A, and otherwise shares many of the same structural elements and details, described in greater detail below for all of the carrying bags 20H, 20K, 20L. Any type of locking zipper pull 1730 may be utilized, including those disclosed in any of U.S. patent application Ser. No. 15/212,823, U.S. patent application Ser. No. 15/212,861, and U.S. patent application Ser. No. 29/623,631, the entire contents of which are incorporated herein by reference with the same full force and effect as if set forth in their entirety herein.

As discussed above, each of the carrying bags 20H, 20K, 20L comprises a security panel assembly 1100, 1100A which forms the carrying bag body and the exterior of the carrying bag 20H, 20K, 20L, without any additional exterior covering. Such a security panel assembly 1100, 1100A is comprised of a plurality of plurality of interwoven, woven, knit, spun, blown, or otherwise embedded or linked, substantially cut-resistant polymer-based fibers, threads or yarns 905, forming a substantially cut-resistant fabric or mesh. The various fibers 905 for the security panel assembly 1100, 1100A may be spaced-apart or abutting, and may be interwoven with other types of threads, yarns or fibers (including metallic fibers, wires, yarns or threads), creating a substantially cut-resistant fabric or mesh having any type of finish or weave to create any desired flexibility, stretchability, texture, or other property of a fabric.

In addition to the various substantially cut-resistant polymer-based fibers, threads or yarns discussed above, the substantially cut-resistant polymer-based fibers, threads or yarns 905 forming a security panel assembly 1100, 1100A, such as a security panel assembly 1100, 1100A which forms the exterior of the carrying bag 20H, 20K, 20L, and/or optionally forming any of the protected seams 1670, 1670A, 1670B, 1710, 1720, may be comprised of a wide variety of materials and compounds, including for example and without limitation: polyethylene fibers, threads or yarns, such as ultra high molecular weight polyethylene ("UHMWPE", e.g., a thermoplastic polyethylene having a molecular mass between about 3.5 and 7.5 million atomic mass units), high-modulus polyethylene ("HMPE"), High Performance Polyethylene ("HPPE"); glass fibers, threads or yarns; nylon fibers, threads or yarns; Cuben Fiber (a laminated fabric constructed from Ultra High Molecular Weight Polyethylene (UHMWPE) fiber monofilaments and polyester, PVF etc. films) ("CTF3"). The resulting security panel assembly 1100, 1100A, and cut-resistant polymer-based fibers, threads or yarns 905 forming any of the protected seams 1670, 1670A, 1670B, 1710, 1720, may have any desired level of cut-resistance or other properties to meet any applicable standard, such as the American National Standards institute ("ANSI") cut level A1-A9 standards or the EN388 standard, for various properties such as blade cut-resistance, abrasion resistance, tear resistance, and puncture resistance. For example and without limitation, in a representative embodiment, the security panel assembly 1100, 1100A which forms the exterior of the carrying bag 20H, 20K, 20L is woven or knit and is substantially blade cut-resistant, and generally also tear and abrasion resistant, but allows some degree of puncture capability to enable the sewing of various seams, tags, decorations, logos, etc., using sewing needles. Also for example and without limitation, the security panel assembly 1100, 1100A which forms the exterior of the carrying bag 20H, 20K, 20L, may have the following specification: ISO 13997:1999 Blade Cut Resistance Level 5=31.5 Newton; ANSI/ISEA 2016 Blade Cut Resistance Level A5/A6=3007 grans/force; EN 388:2003 Tear Strength Level 4=518.2 Newton; EN 388:2003 Abrasion Resistance Level 4=more than 8,000 cycles, and EN 388:2003 Puncture Resistance Level 4=271.6 Newton. Various substantially cut-resistant polymer-based fibers, threads or yarns are available commercially, including Dyneema® (and Cubic Tech) from Royal DSM N.V., The Netherlands and Stanley, N.C., U.S.; Cut-Tex® PRO from PPS S Group, United Kingdom; and Spectra® by Honeywell, Colonial Heights, Va., U.S. The security panel assembly 1100, 1100A also may have any selected coating, such as a rubber or polymer coating, for example and without limitation.

The various cut-resistant polymer-based fibers, threads or yarns 905 utilized to form the security panel assembly 1100, 1100A and/or to form any of the protected seams 1670, 1670A, 1670B, 1710, 1720, may comprise a single strand or multiple strands, with any selected thread count, which in turn may be twisted or braided, for example and without limitation, such as "super braid", "extreme braid", polyethylene-based filament lines such as braided lines of Dyneema® and Spectra®, fishing lines, and which also may be coated, such as to have a slippery coating or film, such as a silicone, plastic, other polymer, or wax coating, also for example and without limitation.

The security panel assembly 1100, 1100A which forms the carrying bag body and the exterior of the carrying bag 20H, 20K, 20L may be configured to have any desired shape or size, such as rectangular, square, circular, trapezoidal, cuboid, rhomboidal, a parallelepiped, ovoid or ellipsoid, or any and all other shapes and sizes, for example and without limitation. In a representative embodiment, the security panel assembly 1100, 1100A is provided as a radial knit, forming a tubular security panel assembly 1100, 1100A which does not require any side seams to form a carrying bag 20H, 20K. The various lower, upper and side seams 1670, 1670A, 1670B, 1710, 1720, as applicable, of the various carrying bags 20H, 20K, 20L are discussed in greater detail below.

In a representative embodiment, the second interior pocket 1580, 1580A is substantially waterproof or water resistant, to any desired level, such that insertion of wet or damp contents into the second interior pocket 1580, 1580A, when fully closed, will not appreciably wet or moisten other contents or the security panel assembly 1100, 1100A which forms the carrying bag body and the exterior of the carrying bag 20K, 20L. Conversely, the second interior pocket 1580, 1580A also may be utilized to keep the contents of the second interior pocket 1580, 1580A dry, when the carrying bag 20K, 20L may become wet or damp. The second interior pocket 1580, 1580A is typically comprised of a substantially waterproof or water resistant fabric, or any other substantially waterproof or water resistant material, including a fabric material which is coated with a polymer or other waterproof or water-resistant coating, and includes one or more fasteners 1605, such as the buckles 1605B illustrated in FIGS. 15-18, hook and loop fasteners 1605A such as Velcro illustrated in FIG. 34, or any other type of fastener, such as snaps, zippers, etc., for example and without limitation. Referring to FIGS. 15-22, a first, upper part 1610 of the second interior pocket 1580, 1580A extends out of the opening 1565 and to the exterior of the carrying bag 20K, 20L, extending further than the upper rim 1615 of the carrying bag body 1502, 1503 of the carrying bag 20K, 20L, while a second, lower part 1620 of the second interior pocket 1580, 1580A is securely anchored within the interior 1625 of the carrying bag 20K, 20L. FIGS. 20 and 21 illustrate example types of anchoring of the second interior pocket 1580, 1580A, and any type of anchoring may be utilized with any type of second interior pocket 1580, 1580A, in addition to those illustrated. As illustrated in FIG. 20, the second interior pocket 1580, 1580A may include tabs or salvage portions 1628 to anchor the second interior pocket 1580, 1580A into the sides of the carrying bag 20K, 20L, including in the carry strap channel 1655 or in the first (upper) seam 1660, for example, or may include tabs or salvage portions 1626 to anchor the second interior pocket 1580 into the second (lower or bottom) seam 1670, 1670B respectively of the carrying bag 20K, 20L. As illustrated in FIG. 21, the second interior pocket 1580, 1580A may include tabs or salvage portions 1627 to anchor the second interior pocket 1580, 1580A into the front or rear walls of the carrying bag 20K, 20L, such as using stitches or seams 1681.

Referring to FIGS. 18 and 19, when contents, such as wet or damp contents are inserted into the interior 1635 of the second interior pocket 1580, 1580A, the opening 1630 is closed, such using one or more fasteners 1605, and the first, upper part 1610 is folded over or rolled, as illustrated in FIG. 18, to form a first closed configuration 1640, which helps secure against any leaking of water or other liquids from or into the opening 1630. Next, the first, upper part 1610 may be further folded, rolled and/or otherwise inserted into the interior 1625, forming a second closed configuration 1645, further securing against any leaking of water or other liquids from or into the opening 1630, and enabling the contents of the second interior pocket 1580, 1580A to be secured within the interior 1625 of the carrying bag 20K, 20L when the carrying bag 20K, 20L is cinched into a closed configuration 1650, illustrated in FIG. 11.

The representative carrying bags 20H, 20K, 20L further comprise a "self-locking" carrying strap 22J, 22K, 22L, as discussed in greater detail below, which is arranged in a strap channel 1655 at the upper portion or top of the carrying bag 20H, 20K, 20L, and has several functions. First, the carry strap 22J, 22K, 22L is substantially cut-resistant, with the structure described in greater detail below with reference to FIGS. 25-29. Alternatively, the representative carry strap 22J, 22K, 22L may be embodied using any of the various carry strap embodiments 22, 22A-22H, such as having any of the internal wire configurations previously discussed above. Second, the carry strap 22J, 22K, 22L also functions to cinch or otherwise pull the top portion of the carrying bag 20H, 20K, 20L into a closed configuration 1650, as illustrated in FIG. 11. Third, the self-locking carry strap 22J, 22K, 22L may also be utilize as a carry strap for holding or positioning the representative carrying bags 20H, 20K, 20L. Lastly, the carry strap 22J, 22K, 22L has a structure which enables locking of the carry strap 22J, 22K, 22L to itself, to lock the carrying bag 20H, 20K, 20L into a closed configuration 1650 as illustrated in FIG. 12, and to lock the carrying bag 20H, 20K, 20L to other structures, as illustrated in FIG. 33.

Referring to FIG. 25, in addition to having an internal wire or cable 38 configuration, the representative carry strap 22J, 22K, 22L further comprises a locking ring 1505, 1505A and one or more reinforced openings, illustrated as through-hole reinforcements (e.g., grommets) 1510 (or other similar eyelet reinforcements), surrounding and/or reinforcing corresponding openings (through-holes or apertures) 1545 extending through the depth or thickness of the representative self-locking carry strap 22J, 22K, 22L, illustrated as at least two through-holes or apertures 1545A and 1545B. The openings (or apertures) 1545 (1545A, 1545B) and through-hole reinforcements (e.g., grommets) 1510 or other reinforced openings and the locking ring 1505, 1505A may have any shape or configuration, in addition to the illustrated circular configuration 1505 and rectangular configuration 1505A, such as square, triangular, elliptical, etc., for example and without limitation. The carry strap 22J, 22K, 22L is arranged at the top or upper portion of the representative carry bags 20G, 20H, 20K, 20L, within the strap channel 1655, and is slideable or otherwise moveable through a plurality of reinforced openings 1520, such as grommets illustrated for carry bag 20G, and knitted or sewn hole reinforcements (such as knitted button hole reinforcements) for carrying bags 20H, 20K, 20L, in strap channel 1655 in the top or upper portion of the representative carrying bag 20G, 20H, 20K, 20L, as illustrated.

As described in greater detail below, the carry strap 22J, 22K, 22L is also anchored within the strap channel 1655 using a coupling 1678, such as a bar tack stitching (illustrated in FIG. 32) through the capping reinforcement 1680 to the exterior of the security panel assembly 1100, 1100A. When the carry strap 22J, 22K, 22L is pulled relative to the strap channel 1655, the top or upper opening 1565 of the representative carrying bag 20G, 20H, 20K, 20L is cinched into a closed configuration 1650. When the carry strap 22J, 22K, 22L is pulled and the representative carrying bag 20G, 20H, 20K, 20L is cinched closed, for a first embodiment (illustrated in FIG. 25), at least two openings (or apertures) 1545 having through-hole reinforcements (e.g., grommets) 1510 or other reinforced openings have been moved out of the strap channel 1655 and can be substantially aligned, such that the shackle 1535 of a lock 1530 may be inserted through the two or more aligned openings (or apertures) 1545A and 1545B of the through-hole reinforcements (e.g., grommets) 1510 (or other reinforced openings) and locked, effectively locking the carry strap 22J, 22K, 22L to itself (thereby being "self-locking") and also thereby locking the representative carrying bag 20G, 20H, 20K, 20L (illustrated in FIG. 12). Depending on the selected length of the carry strap 22J, 22K, 22L, when the representative carrying bag 20G, 20H, 20K, 20L is cinched closed, one end or a loop of the self-locking carry strap 22J, 22K, 22L may be extended further to the exterior or outside of the carrying bag 20G, 20H, 20K, 20L. The self-locking carry strap 22J, 22K, 22L may also be utilized as a carrying strap to carry such carrying bags 20G, 20H, 20K, 20L, and is not limited to its self-locking uses.

In addition, as illustrated in FIG. 33, the self-locking carry strap 22J, 22K, 22L may also be arranged around another object 1575, such as a chair, post or railing, and with the openings (or apertures) 1545 (1545A, 1545B) with grommets 1510 or other reinforced openings then also aligned with each other and with the locking ring 1505, 1505A, with the representative carrying bag 20G, 20H, 20K, 20L cinched or drawn into the closed configuration. The shackle 1535 of a lock 1530 then may be inserted through the aligned openings (or apertures) 1545A, 1545B (reinforced by the grommets 1510 (or other reinforced openings)) and the locking ring 1505, 1505A, and the representative carry bag 20G, 20H, 20K, 20L is effectively locked to or around the object 1575, and further the representative carrying bag 20G, 20H, 20K, 20L is locked into the closed configuration 1650.

While the carry strap 22J, 22K, 22L is illustrated as forming a continuous loop, those having skill in the art will recognize that one end of the carry strap 22J, 22K, 22L instead may be coupled to the exterior bag 23, 23A, and/or or to the security panel assembly 1100, 1100A, or to another part of the carrying bag 20G, 20H, 20K, 20L, rather than being coupled to another part of the carry strap 22J, 22K, 22L to form the loop. To cinch the opening 1565 to a closed configuration, the unattached end of the carry strap 22J, 22K, 22L is also pulled. For locking, at least one opening (or aperture) 1545 with a grommet 1510 or other reinforced opening is exposed, and a shackle 1535 is also inserted through the at least one opening (or aperture) 1545. Provided the lock 1530 is larger than the reinforced opening 1520 of the carrying bag 20G, 20H, 20K, 20L, the carrying bag 20G, 20H, 20K, 20L will then be locked into a closed configuration 1650. Also for example, rather than coupling the ends of the wire cables 38A, 38B to each other, respectively, as illustrated in FIG. 30, each end of the carry strap 22J, 22K, 22L may be reinforced (e.g., using two capping reinforcements 1680) and coupled directly into the strap channel 1655, also forming a loop configuration.

The carrying bags 20H, 20K, 20L are each illustrated using a single carry strap 22J, 22K, 22L which has multiple functions for closing the carrying bag 20H, 20K, 20L (e.g., as a drawstring), carrying, cut-resistance and other security features, and locking of the carrying bag 20H, 20K, 20L. Those having skill in the art will recognize that multiple carry straps 22J, 22K, 22L may also be utilized, including for additional holding or carrying, locking, and closure (drawstring) functionalities, such as illustrated for carrying bag 20G.

As mentioned above, additional security features and structures are incorporated into the carrying bags 20H, 20K, 20L (and, although not separately illustrated, may also be included in any of the other carrying bags herein, including carrying bag 20G). Referring to FIGS. 23A and 23B, the protected or reinforced second (lower or bottom) seam(s) 1670 (1670A, 1670B) is or are significantly secure, having a single lapped structure (illustrated in FIG. 23A) or double-lapped structure (illustrated in FIG. 23B). The single lapped structure 1684 or double-lapped structure 1686, or the French or flat felled seams illustrated below, may be or are also utilized to form protected side seams 1710, 1720 for the carrying bag 20L. In a representative embodiment, a single lapped structure 1684 is formed and secured, using one or more sets of stitches 1624 extending the entire length or circumference of the lower or bottom portion of the security panel assembly 1100, 1100A, followed by forming a double-lapped structure 1686, also secured using one or more sets of stitches 1628 extending the entire length or circumference of the lower or bottom portion of the security panel assembly 1100, 1100A. It should be noted that the stitches 1624 of the first lapped configuration are hidden or "invisible" stitches, which are not apparent or visible from the exterior of the bag, when included in the double-lapped structure 1686. In addition as discussed in greater detail below, hidden or "invisible" line of stitches 1663 may also be utilized in addition to or in place of any of the various stitches 1624, 1628. Having such multiple lines of the various stitches 1624, 1628, helps create added security for the carrying bags 20H, 20K, 20L, such that a potential thief cannot open the carrying bag 20H, 20K, 20L by cutting through a single line of stitches forming one or more side or lower or bottom seams, and further, by making it more difficult to locate or find any hidden or "invisible" line of stitches 1624, 1663 when used to create the protected or reinforced second seam 1670 (1670A, 1670B) or protected side seams 1710, 1720.

Referring to FIGS. 9, and 22-24, the strap channel 1655 is formed by folding the uppermost portion of the security panel assembly 1100, 1100A onto itself, forming first fold 1668, and the first fold is secured using stitches 1672, as illustrated in FIG. 24A. The next upper section of the security panel assembly 1100, 1100A is folded over a second time, forming second fold 1674, and the first fold 1668 is secured to a non-adjacent section 1676 of the security panel assembly 1100, 1100A, allowing space or room for the strap channel 1655, as illustrated in FIG. 24B, using any of the various stitches 1662, 1663, and/or 1664, for the entire length or circumference of the strap channel 1655, for example. In a representative embodiment, at least two separate lines of stitches 1662, 1664, are utilized, for form a protected or reinforced first, top seam 1660. For added, security, in another representative embodiment, a hidden or "invisible" line of stitches 1663 are also utilized, in which the stitches 1663 only partially penetrate the depth or thickness of the exterior portion 1682 of the security panel assembly 1100, 1100A, and hence are not generally visible from the exterior of the carrying bags 20H, 20K, 20L. Having such multiple lines of the various stitches 1662, 1663, and/or 1664 helps create added security for the carrying bags 20H, 20K, 20L, such that a potential thief cannot open the carrying bag 20H, 20K, 20L by cutting through a single line of stitches forming a seam, and further, by making it more difficult to locate or find the hidden or "invisible" line of stitches 1663.

Those having skill in the art will recognize additional methods and structures which may be utilized to form the protected first and second seams 1660, 1670 (1670A, 1670B) and/or any of the protected side seams 1710, 1720, and any and all such variations are considered equivalent and within the scope of the disclosure, including French seams, flat felled seams, bound seams, and other ANSI class 2 and class 3 seams (e.g., 2.04.01-2.04.04), for example and without limitation. In addition, any of the various edges of the security panel assembly 1100, 1100 may be finished, such as by using a serged seam, also for example and without limitation. FIG. 23C illustrates use of a French seam 1688, and FIG. 23D illustrates use of a flat felled seam 1689. Any of these various types of seams, in addition to those illustrated, may be utilized to form any of the protected seams 1670, 1670A, 1670B, 1710, 1720. Also as mentioned above, cut-resistant resistant polymer-based fibers, threads or yarns 905 may be utilized, as an option, to form any of the protected seams 1670, 1670A, 1670B, 1710, 1720.

Referring to FIGS. 26-29, additional security features are included in the carry strap 22J, 22K, 22L. The illustrated carry strap 22J, 22K, 22L includes two wires or cables 38, illustrated as wire or cable 38A and wire or cable 38B, each of which may be comprised of any metallic or nonmetallic wire, cable, fiber, thread or yarn, twisted or untwisted, braided or unbraided, coated or uncoated, and any and all combinations of metallic or nonmetallic wires, cables, fibers, threads or yarns. For example and without limitation, a cut-resistant wire or cable 38 may be comprised of one or more metallic (e.g., steel, titanium) or polymeric fibers, wires, threads or yarns, or various combinations of different materials, including any and all of the various polymeric fibers, threads or yarns 905 discussed above, and as may be combined in any of various ways, such as with metallic or carbon fibers or threads, metal alloys, or elastic or rubber fibers or threads, in any of various combinations, such as a combinations of steel and polymer. In a representative embodiment, the wires or cables 38A, 38B are selected for a combination of flexibility and cut-resistance, not just tensile strength, and may have any of various compositions of multiple metallic or nonmetallic wires, cables, fibers, threads or yarns, including steel wires, cables, fibers, threads or yarns, such as configured as twisted or untwisted 1×3, 1×7, 1×19, 3×7, 7×7, 7×19, 7×37, etc., wires, cables, fibers, threads or yarns, for example and without limitation.

The carry strap 22J, 22K, 22L includes two separate lengths of flexible material referred to as "webbing" material, as first flexible material 527 and second flexible material 528. As illustrated in FIG. 26, a first flexible material 527, such as webbing material (or any of the various other flexible materials (e.g., flexible material 561) utilized to form a carry strap 22J, 22K, 22L) may be described as having finished edges and having its length substantially greater than its width, with a middle (or central) region 562 having any predetermined lateral dimension (width) that is less than the overall width of the flexible material 527, and extending along the length (longitudinal dimension) of the flexible material 527, with the balance of the flexible material 527 being described as respective first and second side or lateral regions 563, 564, also extending along the length (longitudinal dimension) of the flexible material 527. In various embodiments, the middle (or central) region 562 and the first and second side or lateral regions 563, 564 may have a wide range of thicknesses, which may be uniform or non-uniform, e.g., the middle (or central) region 562 may be thicker than the first and second side or lateral regions 563, 564. In other embodiments, such as illustrated in FIGS. 27-28, the middle (or central) region 562 may have about the same thickness as the first and second side or lateral regions 563, 564. For these various embodiments, each of the first and second side or lateral regions 563, 564 may be wrapped around respective cables 38A and 38B laterally (which have been arranged longitudinally along the first and second side or lateral regions 563, 564) and secured in place, such as by sewing or other stitching, illustrated as stitching 565.

For the carry strap 22J, an additional, second and/or third security panel assembly 1100, 1100A is provided in the middle (or central) region 562 around each of the apertures 1545, which are typically formed as welded holes in the first flexible material 527 (and also the second flexible material 528), extending predetermined distances laterally and longitudinally, as illustrated in FIG. 26, i.e., a second security panel assembly 1100, 1100A is arranged around a first aperture 1545A and a third security panel assembly 1100, 1100A is arranged around a second aperture 1545B. For the carry strap 22K, an additional, second security panel assembly 1100, 1100A is also provided in the middle (or central) region 562 around each of the apertures 1545, and extends a predetermined distance laterally and extends longitudinally the entire or most of the length of the carry strap 22K. As a result, yet additional security is provided, as making it very difficult to cut through the carry strap 22J, 22K at any location along the strap generally, and more specifically to cut through or around the through-hole reinforcements (e.g., grommets) 1510, such as to dislodge any shackle 1535. As a variation for carry strap 22L, no such additional second security panel assembly 1100, 1100A is utilized within the strap 22L.

For all of these carry strap 22J, 22K, 22L embodiments, a second flexible (e.g., webbing) material 528, having a second lateral width less than the first lateral width of the first flexible material 527, is provided over the middle (or central) region 562, generally extending laterally to be adjacent or abutting each of the cables 38A, 38B. The respective first and second lateral regions 579A and 579B of the first flexible material 527 are folded then folded over (or wrapped around) the respective wires or cables 38A, 38B, and at least partially covering the second flexible material 528 and any underlying second security panel assembly 1100, 1100A, to laterally enclose the respective wires or cables 38A, 38B, such as through stitching, illustrated as respective seams 565A and 565B, which as an option may utilize any of the various cut-resistant polymeric fibers, threads or yarns 905 discussed above. For each aperture 1545 in the carry strap 22J, 22K, 22L, a through-hole reinforcement 1510 (e.g., respective first and second halves or parts of a grommet 1510A, 1510B) are then arranged or positioned to overlay and also protect the seams 565A and 565B on both the upper and lower sides of the carry strap 22J, 22K, 22L, covering portions of both the first flexible material 527 and the second flexible material 528, and attached or otherwise coupled, providing reinforcement and protection to both the through-hole or aperture 1545, and also covering and protecting the seams 565A and 565B in the vicinity of the aperture 1545.

When the carry strap 22J, 22K, 22L is implemented as a continuous loop, two ends of the carry strap 22J, 22K, 22L are brought together to be adjacent or abutting, and the corresponding two ends of each of the cables 38A, 38B are coupled to each other, respectively (coupling a first end of the cable 38A to a second end of the cable 38A and coupling a first end of the cable 38A to a second end of the cable 38A), such as by using a coupling 1675, such as one or more crimps as illustrated in FIG. 30. The coupled ends of the cables 38A, 38B are further reinforced, using capping reinforcement 1680, which is wrapped around the first and second flexible materials 527, 528 of the carry strap 22J, 22K, 22L and secured at least in the central region 562 of the carry strap 22J, 22K, 22L, such as through a first anchor 1692, illustrated as one or more lines of bar tack stitching extending longitudinally to penetrate through the first and second flexible materials 527, 528 and any intervening materials (such as a second security panel assembly 1100, 1100), as illustrated in FIG. 31. The carry strap 22J, 22K, 22L having the capping reinforcement 1680 is then anchored or otherwise secured to the security panel assembly 1100, 1100A, generally along the side opposite the openings 1520 (FIG. 10) in the region which will form the strap channel 1655, using second anchor or coupling 1678, such as one or more lines of bar tack stitching illustrated in FIGS. 10, 15, and 32. The strap channel 1655 may then be formed by the various folding (around the carry strap 22J, 22K, 22L) and securing as discussed above.

Those having skill in the art will recognize that additional variations of the structure of a carry strap 22J, 22K, 22L are available, and all such variations are considered equivalent and within the scope of the disclosure, as disclosed in the patent applications described above and incorporated herein by reference.

Although the invention has been described with respect to specific embodiments thereof, these embodiments are merely illustrative and not restrictive of the invention. In the description herein, numerous specific details are provided, such as examples of electronic components, electronic and structural connections, materials, and structural variations, to provide a thorough understanding of embodiments of the present invention. One skilled in the relevant art will recognize, however, that an embodiment of the invention can be practiced without one or more of the specific details, or with other apparatus, systems, assemblies, components, materials, parts, etc. In other instances, well-known structures, materials, or operations are not specifically shown or described in detail to avoid obscuring aspects of embodiments of the present invention. One having skill in the art will further recognize that additional or equivalent method steps may be utilized, or may be combined with other steps, or may be performed in different orders, any and all of which are within the scope of the claimed invention. In addition, the various Figures are not drawn to scale and should not be regarded as limiting.

Reference throughout this specification to "one embodiment", "an embodiment", or a specific "embodiment" means that a particular feature, structure, or characteristic described in connection with the embodiment is included in at least one embodiment and not necessarily in all embodiments, and further, are not necessarily referring to the same embodiment. Furthermore, the particular features, structures, or characteristics of any specific embodiment may be combined in any suitable manner and in any suitable combination with one or more other embodiments, including the use of selected features without corresponding use of other features. In addition, many modifications may be made to adapt a particular application, situation or material to the essential scope and spirit of the present invention. It is to be understood that other variations and modifications of the embodiments of the present invention described and illustrated herein are possible in light of the teachings herein and are to be considered part of the spirit and scope of the present invention.

It will also be appreciated that one or more of the elements depicted in the Figures can also be implemented in a more separate or integrated manner, or even removed or rendered inoperable in certain cases, as may be useful in accordance with a particular application. Integrally formed combinations of components are also within the scope of the invention, particularly for embodiments in which a separation or combination of discrete components is unclear or indiscernible. In addition, use of the term "coupled" herein, including in its various forms such as "coupling" or "couplable", means and includes any direct or indirect structural coupling, connection or attachment, or adaptation or capability for such a direct or indirect structural coupling, connection or attachment, including integrally formed components and components which are coupled via or through another component.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

Furthermore, any signal arrows in the drawings/Figures should be considered only exemplary, and not limiting, unless otherwise specifically noted. Combinations of components of steps will also be considered within the scope of the present invention, particularly where the ability to separate or combine is unclear or foreseeable. The disjunctive term "or", as used herein and throughout the claims that follow, is generally intended to mean "and/or", having both conjunctive and disjunctive meanings (and is not confined to an "exclusive or" meaning), unless otherwise indicated. As used in the description herein and throughout the claims that follow, "a", "an", and "the" shall not be limited to a single item or element and include plural references unless the context clearly dictates otherwise and unless specifically disclaimed. Also as used in the description herein and throughout the claims that follow, the meaning of "in" includes "in" and "on" unless the context clearly dictates otherwise. By way of example, though specific claim language may include the word "between", the interpretation of such a word shall not be limited to preclude extent of elements beyond boundaries of the example unless specific disclaimer is made or unless by virtue of prosecution the term is to be limited. The examples of the invention should therefore not be interpreted as limiting unless indicated as such.

The foregoing description of illustrated embodiments of the present invention, including what is described in the summary or in the abstract, is not intended to be exhaustive or to limit the invention to the precise forms disclosed herein. From the foregoing, it will be observed that numerous variations, modifications and substitutions are intended and may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims. Thus, while there has been set forth embodiments of the invention, the invention is to be limited only by the following claims and equivalents.

What is claimed is:

1. A carrying bag comprising:

a carrying bag body having an interior and an exterior, the carrying bag body comprising:

a first security panel assembly comprising a first plurality of cut-resistant polymer-based fibers, threads or yarns forming a first fabric or mesh; and a strap channel arranged in an upper or first part of the first security panel assembly forming the carrying bag body, the strap channel having at least two spaced-apart reinforced channel openings;

a water-resistant pocket having a first part coupled within the interior of the carrying bag body and having a second part extending to the exterior of the carrying bag body;

a fastener coupled to the water-resistant pocket to fasten the water-resistant pocket in a first closed position external to the carrying bag body; and a carrying strap arranged in the strap channel and extending through the at least two spaced-apart reinforced channel openings, the carrying strap comprising:

a first wire cable;

a second wire cable extending substantially parallel to and spaced-apart from the first wire cable;

a first flexible material having first and second lateral regions and a central region in between the first and second lateral regions, the first lateral region folded around the first wire cable to enclose the first wire cable and the second lateral region folded around the second wire cable to enclose the second wire cable; and a second flexible material arranged on or over the central region of the first flexible material.

2. The carrying bag of claim 1, wherein each of the first and second flexible materials further comprise spaced-apart first and second apertures, each of the first and second apertures extending through both the first and second flexible materials, and wherein the carrying strap further comprises:

first and second through-hole reinforcements correspondingly coupled to the first and second apertures and to the first and second flexible materials.

3. The carrying bag of claim 2, wherein the carrying strap further comprises:

a second security panel assembly comprising a second plurality of cut-resistant polymer-based fibers, threads or yarns forming a second fabric or mesh, the second security panel assembly arranged around the first aperture and in between the first and second flexible materials; and a third security panel assembly comprising a third plurality of cut-resistant polymer-based fibers, threads or yarns forming a third fabric or mesh, the third security panel assembly arranged around the second aperture and in between the first and second flexible materials.

4. The carrying bag of claim 2, wherein the carrying strap further comprises:

a second security panel assembly comprising a second plurality of cut-resistant polymer-based fibers, threads or yarns forming a second fabric or mesh, the second security panel assembly arranged in between the first and second flexible materials and around the first and second apertures.

5. The carrying bag of claim 2, wherein first through-hole reinforcement comprises a first grommet and the second through-hole reinforcement comprises a second grommet.

6. The carrying bag of claim 2, wherein the first lateral region of the first flexible material is further folded to overlay and be coupled through a first strap seam to a first lateral region of the second flexible material, and wherein the second lateral region of the first flexible material is further folded to overlay and be coupled through a second strap seam to a second lateral region of the second flexible material.

7. The carrying bag of claim 6, wherein the first and second through-hole reinforcements are further coupled over the first and second strap seams coupling the first and second flexible materials.

8. The carrying bag of claim 1, wherein the carrying strap further comprises a locking ring.

9. The carrying bag of claim 1, further comprising:

one or more crimps coupling a first end of the first wire cable to a second end of the first wire cable and coupling a first end of the second wire cable to a second end of the second wire cable to form a loop structure for the carrying strap.

10. The carrying bag of claim 9, further comprising:

a capping reinforcement coupled over the one or more crimps and coupled to the first and second flexible materials, the capping reinforcement further coupled to the strap channel.

11. The carrying bag of claim 1, wherein the strap channel further comprises:

a first protected seam having a plurality of rows of stitching, each row of stitching extending around a circumference of the carrying bag body.

12. The carrying bag of claim 11, wherein the first protected seam further comprises a plurality of hidden stitches which do not extend to the exterior of the carrying bag body.

13. The carrying bag of claim 11, wherein the carrying bag body further comprises:

a second protected seam arranged on a lower or second part of the carrying bag body, the second protected seam having a double-lapped structure, the double-lapped structure comprising a first lapped structure and a second lapped structure, the first lapped structure having a plurality of hidden stitches which do not extend to the exterior of the carrying bag body.

14. The carrying bag of claim 11, wherein the carrying bag body further comprises:

a second protected seam arranged on a lower or second part of the carrying bag body, the second protected seam selected from the group consisting of: a single-lapped seam, a double-lapped seam, a French seam, a flat felled seam, and a bound seam.

15. The carrying bag of claim 1, wherein the carrying bag body has an upper rim, the carrying bag body further having a protected seam, and wherein the first part of the water-resistant pocket is coupled within the interior to the protected seam, and the second part of the water-resistant pocket is extendable past the upper rim to the exterior of the carrying bag body.

16. The carrying bag of claim 1, wherein the second part of the water-resistant pocket is foldable to be placed within the interior in a second closed position.

17. The carrying bag of claim 1, wherein the carrying bag body has an upper rim, and wherein the water-resistant pocket further comprises a plurality of side tabs coupled within the interior to one or more sides of the carrying bag body, with the water-resistant pocket extending past the upper rim to the exterior of the carrying bag body.

18. The carrying bag of claim 1, wherein the reinforced channel openings further comprise welded and knit channel openings.

19. A carrying bag comprising:

a carrying bag body having an interior and an exterior, the carrying bag body comprising:

a first security panel assembly comprising a plurality of cut-resistant polymer-based fibers, threads or yarns forming a first fabric or mesh; and a strap channel arranged in an upper or first part of the carrying bag body, the strap channel having at least two spaced-apart reinforced channel openings;

a water-resistant pocket having a first part coupled within the interior of the carrying bag body and having a second part extending to the exterior of the carrying bag body;

a fastener coupled to the water-resistant pocket to fasten the water-resistant pocket in a first closed position external to the carrying bag body; and a carrying strap arranged in the strap channel and extending through the at least two spaced-apart reinforced channel openings, the carrying strap comprising:

a first wire cable;

a second wire cable extending substantially parallel to and spaced-apart from the first wire cable;

a first flexible material and a second flexible material, each of the first and second flexible materials having first and second lateral regions and a central region in between the first and second lateral regions, the second flexible material arranged on or over the central region of the first flexible material, the first lateral region of the first flexible material folded around the first wire cable to enclose the first wire cable and to overlay the first lateral region of the second flexible material, and the second lateral region of the first flexible material folded around the second wire cable to enclose the second wire cable and to overlay the second lateral region of the second flexible material, and each of the first and second flexible materials having spaced-apart first and second apertures, each of the first and second apertures extending through both the first and second flexible materials; and first and second through-hole reinforcements correspondingly coupled to the first and second apertures and to the first and second flexible materials.

20. The carrying bag of claim 19, wherein the carrying strap further comprises:

a second security panel assembly comprising a second plurality of cut-resistant polymer-based fibers, threads or yarns forming a second fabric or mesh, the second security panel assembly arranged around the first aperture and in between the first and second flexible materials; and a third security panel assembly comprising a third plurality of cut-resistant polymer-based fibers, threads or yarns forming a third fabric or mesh, the third security panel assembly arranged around the second aperture and in between the first and second flexible materials.

21. The carrying bag of claim 19, wherein the carrying strap further comprises:

a second security panel assembly comprising a second plurality of cut-resistant polymer-based fibers, threads or yarns forming a second fabric or mesh, the second security panel assembly arranged in between the first and second flexible materials and around the first and second apertures.

22. The carrying bag of claim 19, wherein first through-hole reinforcement comprises a first grommet and the second through-hole reinforcement comprises a second grommet.

23. The carrying bag of claim 19, wherein the first lateral region of the first flexible material is coupled through a first strap seam to the first lateral region of the second flexible material, and wherein the second lateral region of the first flexible material is coupled through a second strap seam to the second lateral region of the second flexible material; and wherein the first and second through-hole reinforcements are further coupled over the first and second strap seams coupling the first and second flexible materials.

24. The carrying bag of claim 19, further comprising:

one or more crimps coupling a first end of the first wire cable to a second end of the first wire cable and coupling a first end of the second wire cable to a second end of the second wire cable to form a loop structure for the carrying strap.

25. The carrying bag of claim 24, further comprising:

a capping reinforcement coupled over the one or more crimps and coupled to the first and second flexible materials, the capping reinforcement further coupled to the strap channel.

26. The carrying bag of claim 19, wherein the strap channel further comprises:

a protected seam having a plurality of rows of stitching, each row of stitching extending around a circumference of the carrying bag body, wherein the protected seam further comprises a plurality of hidden stitches which do not extend to the exterior of the carrying bag body.

27. The carrying bag of claim 19, wherein the carrying bag body further comprises:

a protected seam arranged on a lower or second part of the carrying bag body, the protected seam having a double-lapped structure, the double-lapped structure comprising a first lapped structure and a second lapped structure, the first lapped structure having a plurality of hidden stitches which do not extend to the exterior of the carrying bag body.

28. The carrying bag of claim 19, wherein the carrying bag body further comprises:

a protected seam arranged on a lower or second part of the carrying bag body, the second protected seam selected from the group consisting of: a single-lapped seam, a double-lapped seam, a French seam, a flat felled seam, and a bound seam.

29. The carrying bag of claim 19, wherein the carrying bag body has an upper rim, the carrying bag body further having a protected seam, and wherein the first part of the water-resistant pocket is coupled within the interior to the protected seam, and the second part of the water-resistant pocket extends past the upper rim to the exterior of the carrying bag body.

30. The carrying bag of claim 19, wherein the second part of the water-resistant pocket is foldable to be placed within the interior in a second closed position.

31. The carrying bag of claim 19, wherein the carrying bag body has an upper rim, and wherein the water-resistant pocket further comprises a plurality of side tabs coupled within the interior to one or more sides of the carrying bag body, with the water-resistant pocket extendable past the upper rim to the exterior of the carrying bag body.

32. A carrying bag comprising:

a carrying bag body having an upper rim, an exterior and an interior, the carrying bag body comprising:

a security panel assembly comprising a plurality of cut-resistant polymer-based fibers, threads or yarns forming a fabric or mesh;

a strap channel arranged in an upper or first part of the security panel assembly forming the carrying bag body, the strap channel having at least two spaced-apart reinforced channel openings;

a protected seam arranged on a lower or second part of the carrying bag body, the protected seam having a double-lapped structure, the double-lapped structure comprising a first lapped structure and a second lapped structure, the first lapped structure having a plurality of hidden stitches which do not extend to the exterior of the carrying bag body;

a water-resistant pocket having a first part coupled within the interior to the protected seam, and the water-resistant pocket having a second part extending past the upper rim to the exterior of the carrying bag body;

a fastener coupled to the water-resistant pocket to fasten the water-resistant pocket in a closed position external to the carrying bag body; and a carrying strap arranged in the strap channel and extending through the at least two spaced-apart reinforced channel openings, the carrying strap comprising:

a first wire cable;

a second wire cable extending substantially parallel to and spaced-apart from the first wire cable;

a first flexible material and a second flexible material, each of the first and second flexible materials having first and second lateral regions and a central region in between the first and second lateral regions, the second flexible material arranged on or over the central region of the first flexible material, the first lateral region of the first flexible material folded around the first wire cable to enclose the first wire cable and coupled through a first strap seam to the first lateral region of the second flexible material, and the second lateral region of the first flexible material folded around the second wire cable to enclose the second wire cable and coupled through a second strap seam to the second lateral region of the second flexible material, and each of the first and second flexible materials having spaced-apart first and second apertures, each of the first and second apertures extending through both the first and second flexible materials; and first and second through-hole reinforcements correspondingly coupled to the first and second apertures and further coupled over the first and second strap seams coupling the first and second flexible materials to the first and second flexible materials.

* * * * *